US007806360B2

(12) United States Patent
Chadwick

(10) Patent No.: US 7,806,360 B2
(45) **Date of Patent: *Oct. 5, 2010**

(54) CREEL MAGAZINE SUPPLY SYSTEM AND METHOD

(75) Inventor: David Chadwick, Alpharetta, GA (US)

(73) Assignee: Automated Creel Systems, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/253,398

(22) Filed: Oct. 17, 2008

(65) Prior Publication Data

US 2009/0101749 A1 Apr. 23, 2009

Related U.S. Application Data

(63) Continuation-in-part of application No. 11/875,254, filed on Oct. 19, 2007.

(51) Int. Cl.

| | |
|---|---|
| ***B65H 67/00*** | (2006.01) |
| ***B65H 49/00*** | (2006.01) |
| ***D02H 1/00*** | (2006.01) |

(52) U.S. Cl. ..... 242/560; 242/131; 28/193; 66/125 R

(58) Field of Classification Search ..... 242/551, 242/557, 558, 559, 559.3, 560, 588, 590, 242/593, 594, 594.6, 597, 597.8, 131, 131.1; 139/246–252; 414/222.01, 267, 331; 66/125 R, 66/125 A, 168; 28/190, 193

See application file for complete search history.

(56) References Cited

U.S. PATENT DOCUMENTS

| | | | | |
|---|---|---|---|---|
| 3,321,153 | A * | 5/1967 | Bryan, Jr. | 242/131 |
| 3,377,677 | A * | 4/1968 | Furst | 28/193 |
| 4,498,644 | A * | 2/1985 | Kupper et al. | 242/131.1 |
| 4,852,824 | A * | 8/1989 | Beitz et al. | 242/131.1 |
| 5,451,006 | A * | 9/1995 | Smith | 242/131.1 |
| 5,927,629 | A * | 7/1999 | Dixon | 242/150 R |

* cited by examiner

*Primary Examiner*—John Q Nguyen
*Assistant Examiner*—William E Dondero
(74) *Attorney, Agent, or Firm*—Smith, Gambrell & Russell

(57) ABSTRACT

A creel magazine for continuously delivering packaged stranded material to a manufacturing process. A plurality of magazines linearly disposed in substantially parallel alignment are alternately supplied stranded materials fed to the manufacturing process from movable magazine cartridges supporting packages of stranded materials form either side of the magazine frame. The apparatus and method provide for sequential delivery of stranded materials from packages supported by cartridges at the sides of the magazines, intermediate replenishment of the depleted cartridges with cartridges loaded with replenished packages.

21 Claims, 18 Drawing Sheets

CREEL MAGAZINE SUPPLY SYSTEM AND METHOD

CROSS REFERENCE TO RELATED APPLICATIONS

This application is a continuation in part of U.S. patent application Ser. No. 11/875,254, filed Oct. 19, 2007.

BACKGROUND OF THE INVENTION

1. Technical Field

The present invention generally relates to creels used for supplying stranded materials to a machine or process for subsequent treatment of the stranded materials or for the fabrication of articles out of the stranded materials. More particularly, the present invention relates to an apparatus and method for supporting a plurality of spools of stranded material, or packages, such that the stranded material carried by the packages may be sequentially supplied to a machine or industrial process. With even greater particularity, the invention relates to a creel magazine capable of receiving and guiding a predetermined number of strands of material to a machine or industrial process, wherein a creel cartridge carries a plurality of material packages sequentially connected for each of the predetermined strands.

2. Related Art

The use of creels for supporting stranded material packages is well known in the textile industry and finds application in other industries utilizing stranded materials as well. Modern high-speed processing systems require a continuous, uninterrupted supply of yarns, fed from a plurality of yarn packages supported throughout the creel. However, despite their widespread use, the task of loading and maintaining the supply of stranded materials in the creel remains an extremely labor intensive operation, involving both gross and fine motor skills. Moreover, the efficiency of these systems is dependent upon the ability to provide a continuous stream of material to the process. Interruptions of the process are usually caused by a breakage of the stranded material which occur most frequently where successive material packages are joined, such as by a knot or other methods well known in the art.

Depending on the location of the breakage, process down time can be a matter of minutes, reflecting system shutdown, fault diagnosis, rejoining the broken strands, and system restart procedures. Moreover, modern high speed processing systems are usually designed with fault detection measures that are intended to prevent broken strands from entering the processing machinery. However, should these systems fail and a strand breakage enters the system, or where a strand breaks internally of the system, delays on the order of hours may be experienced as the entire machine will need to be reset.

Conventional creel systems utilize yarn package supports which are arrayed on a plurality of support posts extending from a free standing frame of the creel and positioned so as to feed the manufacturing process. Eyelets or other guide means are provided vertically and laterally throughout the creel through which each of a plurality of yarn strands are fed to the processing system. Accordingly, monitoring, loading and maintenance of the creel is performed from a front side of the creel so that the operators will not be exposed to hazards presented by running lengths of stranded materials extending from the back side of the creel. In the typical process, a pair of package supports are configured in alignment with each eyelet and the respective yarn strands from the paired packages are tied or otherwise attached in series to alternately feed the process.

Replacement of a yarn package in a creel typically requires a worker to remove a depleted package cone out of the creel from its working position to a loading position; remove and dispose of a spent cone from the package holder; lift the replacement yarn package from a delivery platform, such as a pallet or bulk container cart; transport the package to the indicated package support; manipulate the package to mount it on the package support; rotate the replenished package support into the creel; and tie or otherwise secure the lead end of the replenished yarn package to the tail end of the paired feeding yarn package. As can be readily seen, the operation and maintenance of a typical creel is and remains a labor intensive task In systems utilizing manual loading methods, a typical package will be limited to having a weight on the order of 8 to 14 pounds. In a given shift, a textile worker tasked with loading and maintaining the creel in a conventional process will lift, transport, and manipulate as much as six thousand pounds of packaged materials. Because the package supports are arrayed at varying heights and distances from the delivery platform, the typical laborer is subjected to significant risk of musculo-skeletal injuries presented at each step of the yarn package replacement process. Moreover, because the loading and replenishment of individual packages occurs at the creel, the activity remains a complex labor intensive one when combined with the related tasks of monitoring the condition, maintenance and performance of the system. Accordingly, there remains a need for improving the efficiency and reducing the complexity of creel operations.

BRIEF SUMMARY OF THE INVENTION

An object of the present invention is to improve the efficiency of creel systems utilized in manufacturing processes utilizing packages of stranded materials. This object is realized by providing the packages with a pre configured supply of materials ready for direct loading into the creel. The preconfigured supply of materials, carried on movable carts, or cartridges, are preferably loaded by automated means at a separate work station. More preferably, the packages are loaded directly onto the cartridge following completion of a preceding process, typically loading of the packages with the stranded material. Another object of the invention is to provide means for reducing the complexity of operator tasks performed at the creel, thereby relieving the risk of musculo-skeletal stresses on the laborers tasked to operate a creel and improving efficiency and performance of the operator manning that station.

The invention also alleviates risks to operators associated with high speed running strands of material as they are supplied to the process, such as the risk of severing appendages. This hazard is reduced significantly by elevating the running strands overhead of the operator's work station.

BRIEF DESCRIPTION OF THE SEVERAL DRAWINGS

DETAILED DESCRIPTION OF THE INVENTION

Figure 1:
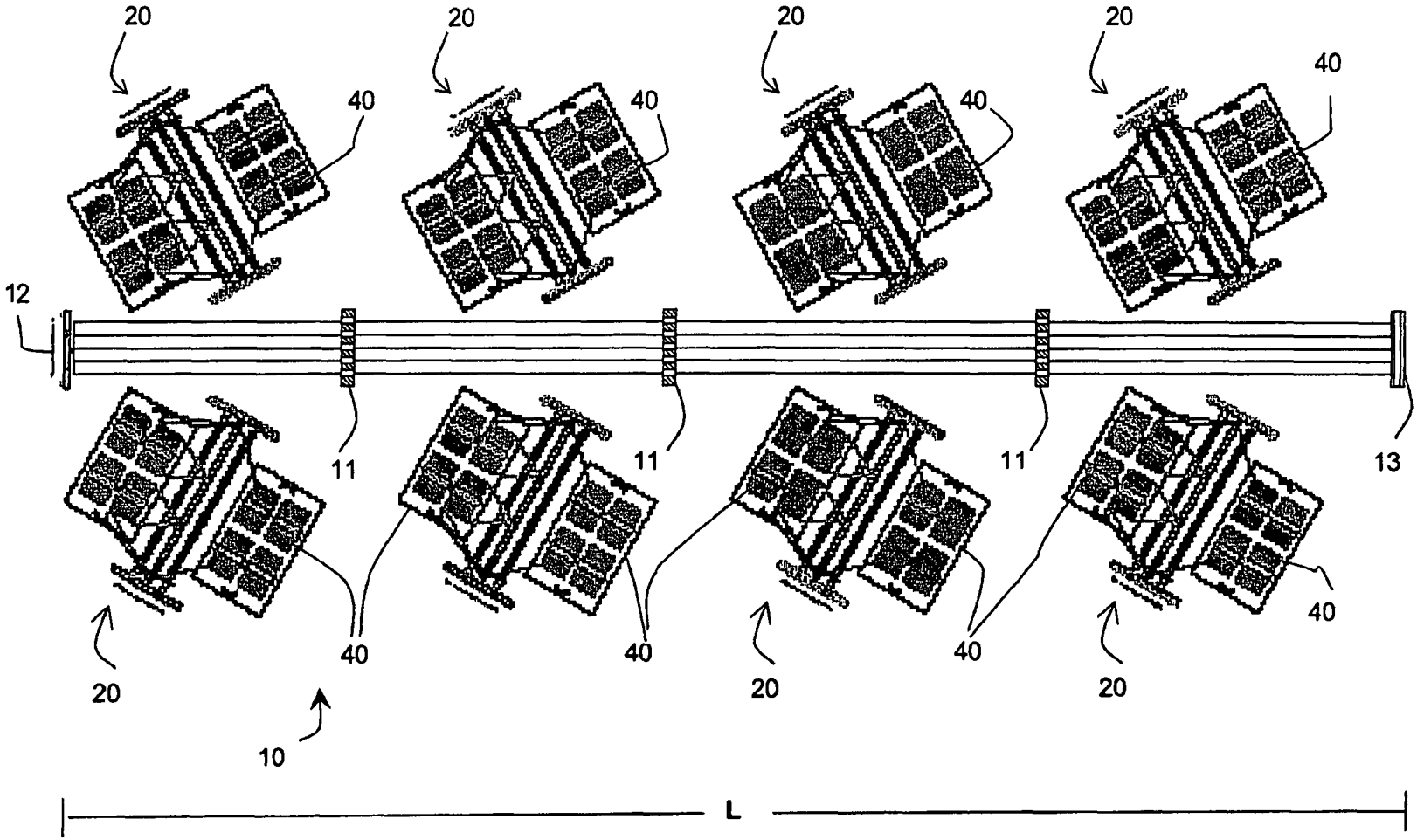
FIG. 1 depicts an overhead plan view of a stranded material magazine supply system for a manufacturing process.
Figure 2:
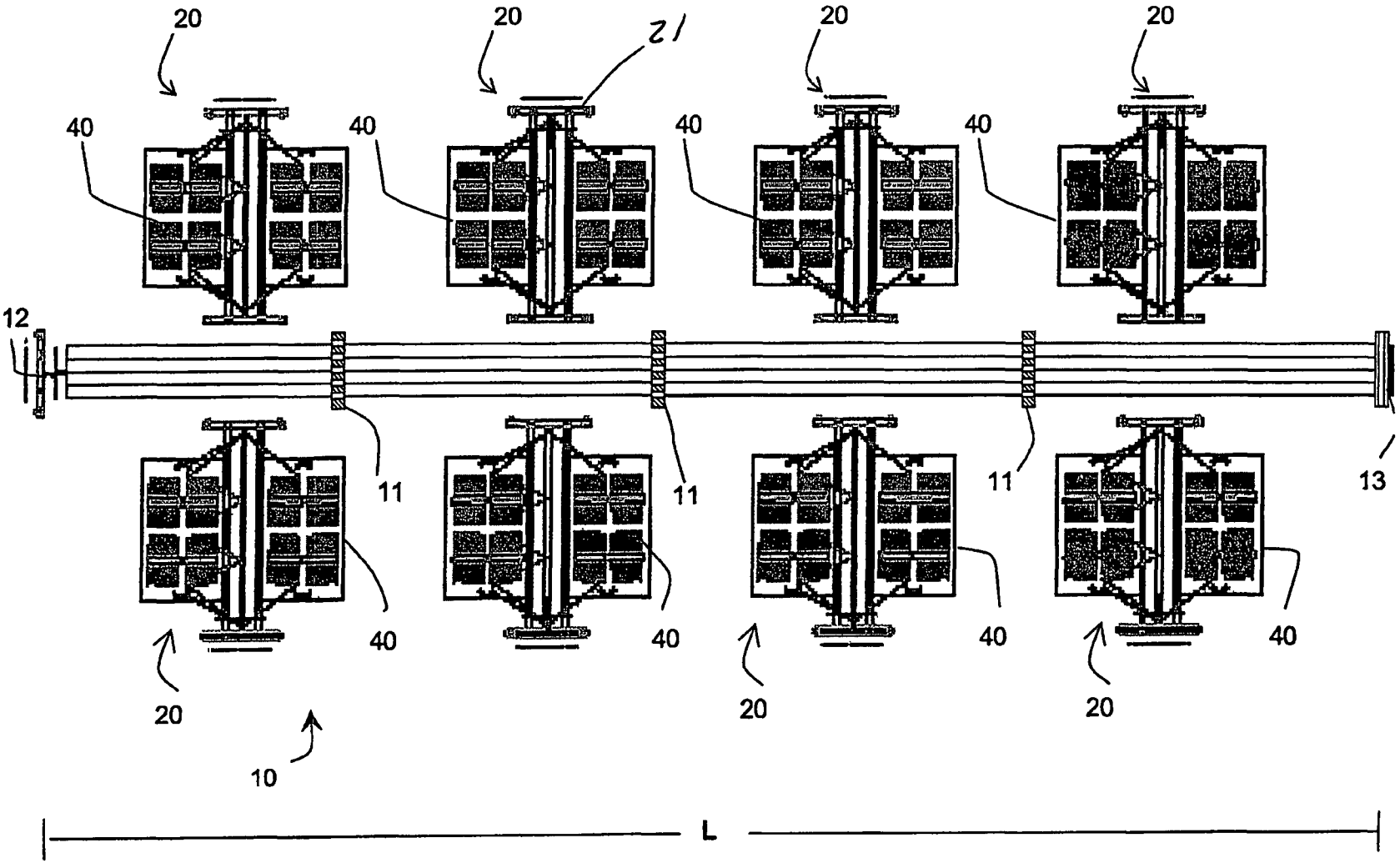
FIG. 2 depicts an alternative overhead plan view of a stranded material magazine supply system for a manufacturing process.
Figure 3:
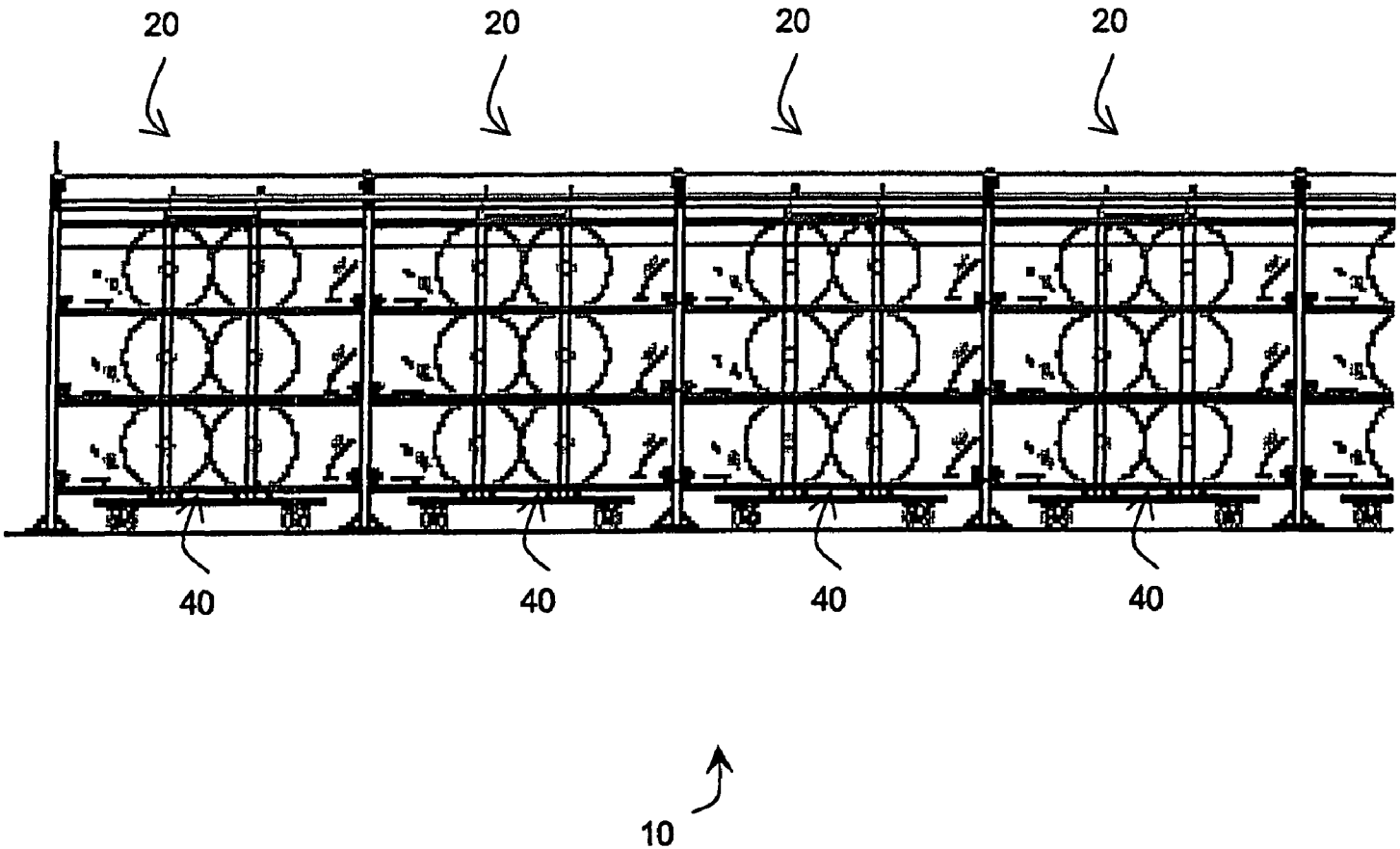
FIG. 3 depicts a side elevational view of a stranded material magazine supply system for a manufacturing process.

The creel magazine supply system and method of the present invention may be constructed as a complete system or is adaptable to an existing manufacturing facility working with stranded materials. In reference to FIGS. 1-4, the system comprises a creel 10, a plurality of creel magazine 20 each servicing a plurality of spools of stranded material, or packages 30. After leaving the creel magazines 20, the running ends of the stranded material S are routed to the manufacturing process via creel 10 comprising a plurality of guides 11, guide boards 12, or return rollers 13, supported in the facility according to conventional methods. As will be appreciated by those of skill in the art the length of the creel run L, is generally determined by the machine or process treating the stranded material, particularly with respect to parameters for detecting and preventing material breaks from entering the machine proper, such as the machine operating speed, break detection time, and machine interrupt or shut down times.

The creel magazine supply system and method is designed around magazine 20 comprising a stationary magazine frame 21 and a pair of movable, replenishable carts, or cartridges 40. Each cartridge 40 is configured to carry a plurality of packages 30. As may be seen in reference to FIGS. 5 and 6, each cartridge 40 is configured to carry packages 30 in an array of two vertical columns and three rows at a depth of two packages 30 each, for a total of twelve packages 30 per cartridge 40, and total of twenty four packages 30 in a magazine 20 utilizing two cartridges 40. In the embodiment described, cartridge 40 allows for six running ends of material S to be fed to creel 10 at a time.

As may be appreciated, magazines 20 can be arranged to supply creel 10 with any number of running ends of material S. Utilizing the maximum capacity of each magazine 20 configured as described above, incremental strand counts of 48, 42, 36, 30, 24 may be readily achieved according to the needs of the manufacturing process by the addition or subtraction of magazines 20 to the site layout. Magazines 20 may be arranged any number of ways determined by the physical dimensions and process requirements of the manufacturing facility. In a preferred configuration, such as that depicted in FIG. 1, magazines 20 will be angled with respect to the creel run L towards return roller 13 to help reduce friction on the material S and drag on the machine as it pulls the material into the process. An angled design also allows for better access to the magazine 20 and cartridges 40 or carts for tying and routing strands and other maintenance tasks. Maintenance in this area is typically referred to as a "break out" and must be attended to by the machine operator.

Figure 8:
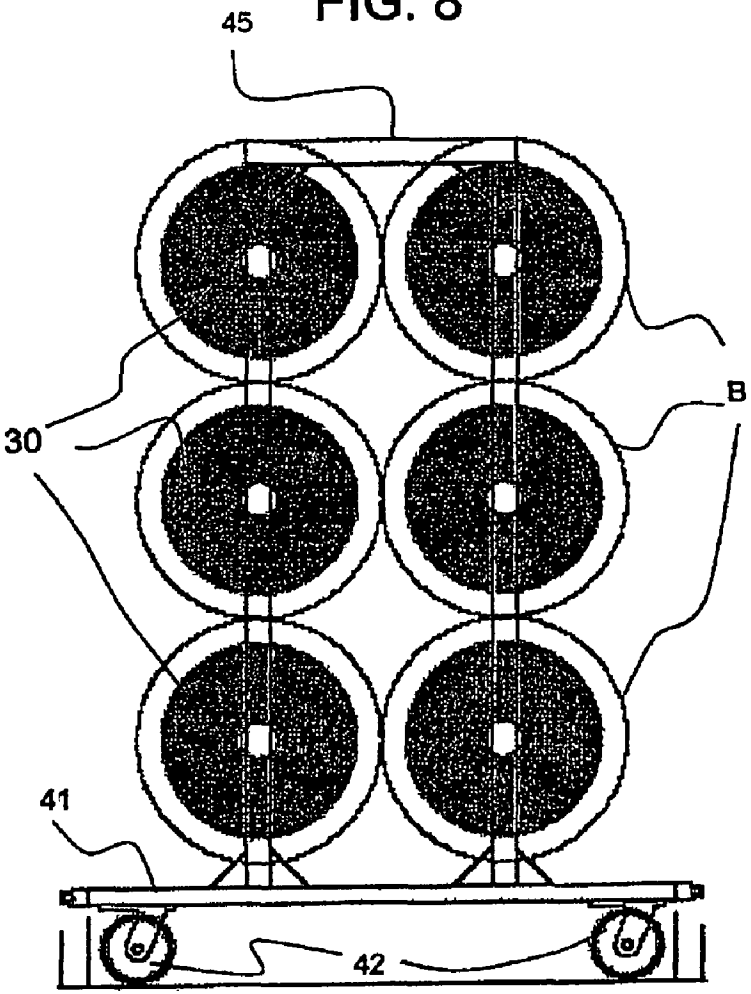
FIG. 8 depicts a side elevational view of a cartridge.
Figure 7:
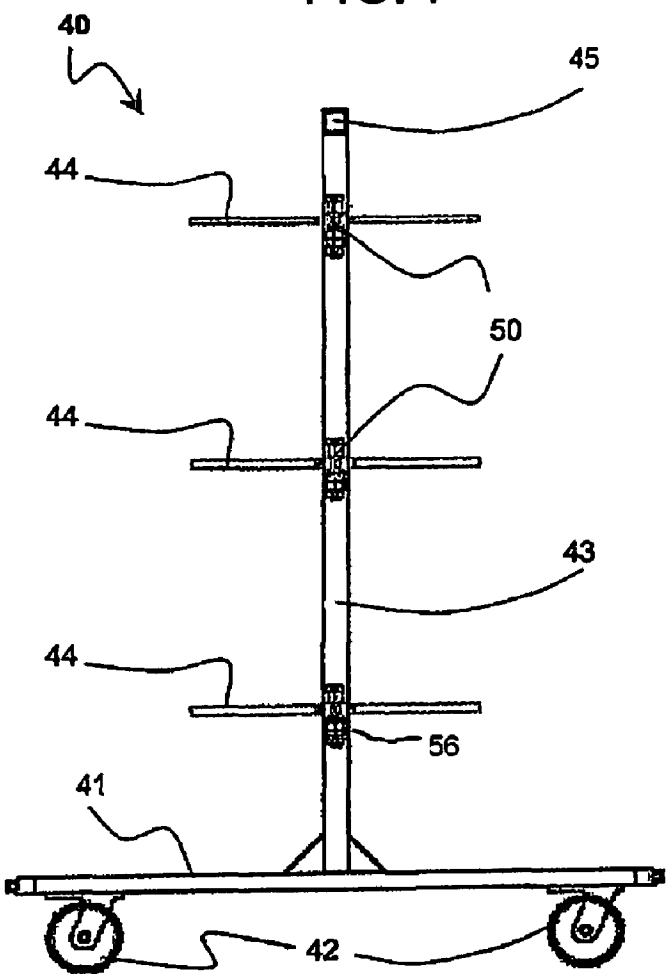
FIG. 7 depicts an end view of a cartridge.
Figure 10A:
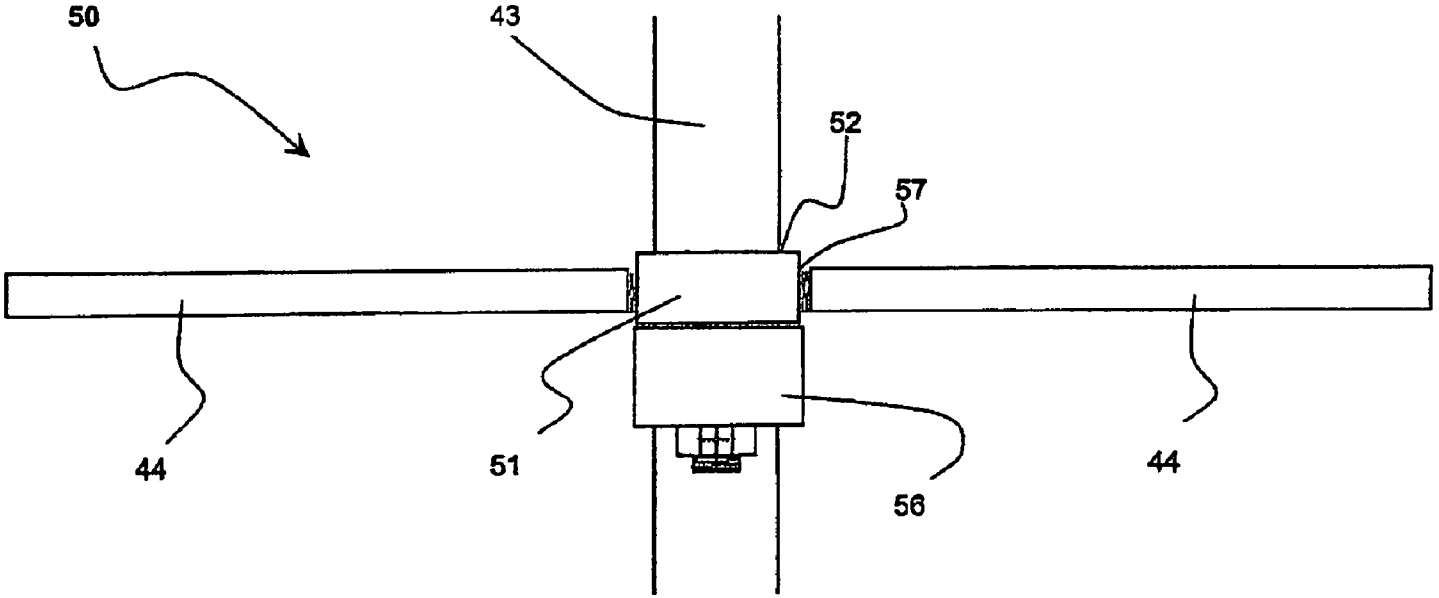
FIG. 10A depicts a side elevational view of a cartridge post and package rotator.
Figure 10B:
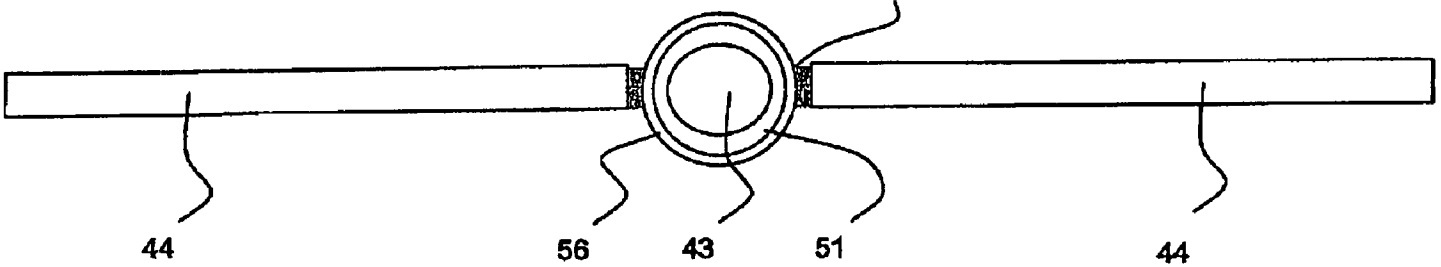
FIG. 10B depicts an overhead plan view of a cartridge post and package rotator.

In reference to FIGS. 7-8, replaceable cartridge or cart 40, is comprised of a platform 41 supported by ground wheels 42 and a post or vertical frame 43 mounted to and extending from platform 41. In the embodiment depicted, support arms 44 are provided in opposed pairs, pivotally mounted to vertical frame 43 via a package rotator 50. As shown in FIGS. 10A and 10B, package rotator 50 is comprised of support arms 44 attached to and extending laterally outwardly from a collar 51. Collar 51 rotates about a rotator bearing surface 52, which is provided with a guide channel 53. Guide channel 53 receives a guide pin 54 extending from an inner surface of collar 51, to guide and constrain the extent of rotation of support arms 44. Guide channel 53 should also have a detent 55 to ensure positive alignment of support arm 44 and to alert the operator when support arm 44 is rotated to the correct position.

As may be seen, package rotators 50 are attached to vertical frame 43 to define an array having a predetermined number of columns, rows and banks based upon facility requirements or other operational considerations. In this embodiment support arms 44 are arranged in a 2×3×2 array, that is two columns, three rows, and two banks, on vertical frame 43 for a total of twelve packages 30 per cartridge 40. A horizontal frame member 45 may be provided between adjacent vertical frame members 43 for added support. In the configuration depicted in FIGS. 7-8, package rotator 50 permits rotation of support arms 44 through an arc of 180 degrees about a vertical axis corresponding to the respective vertical frame member 43.

Figure 4B:
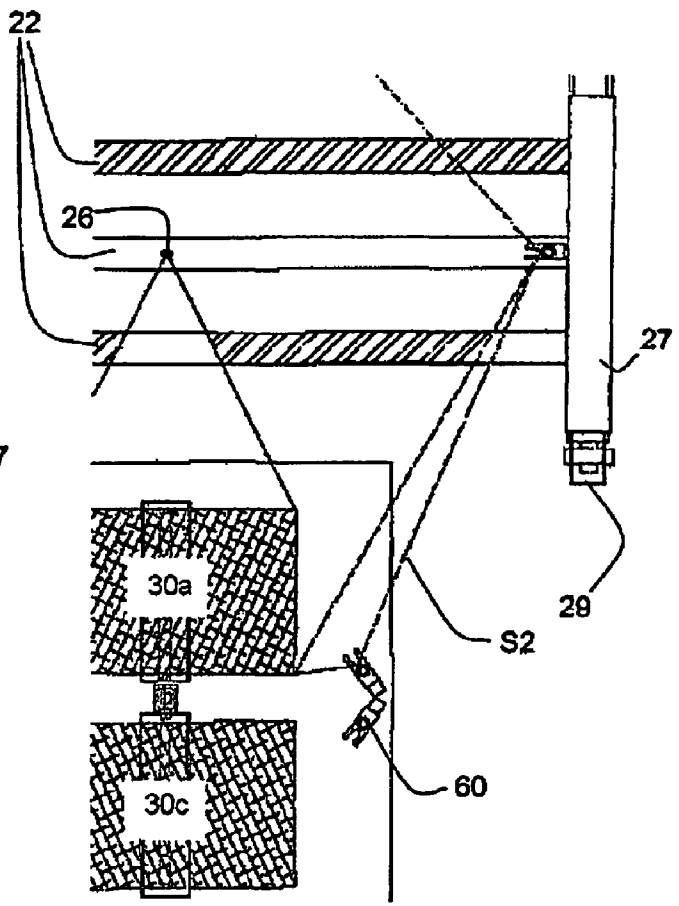
FIG. 4B depicts a detailed view of material routing in the magazine shown in 4A.
Figure 4A:
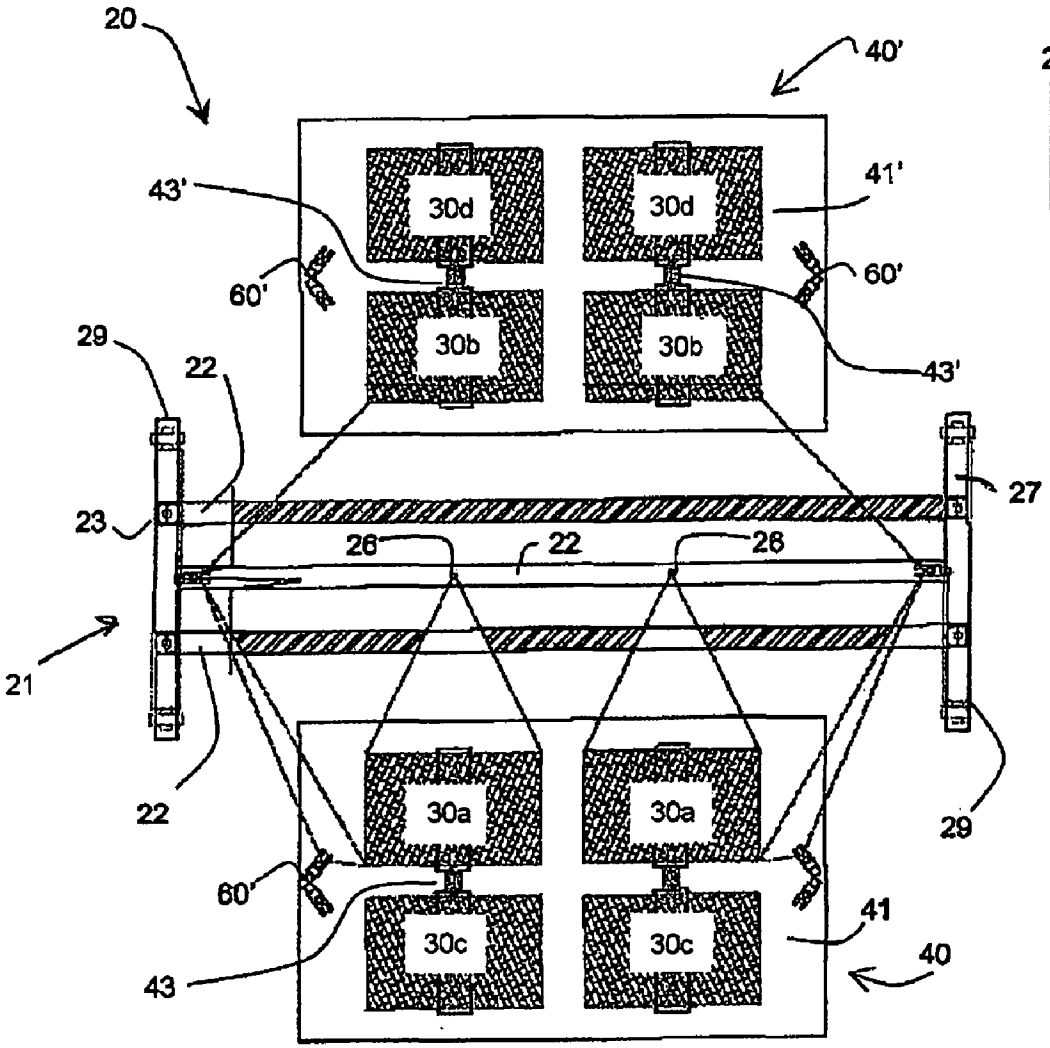
FIG. 4A depicts an overhead plan view of a magazine.
Figure 5:
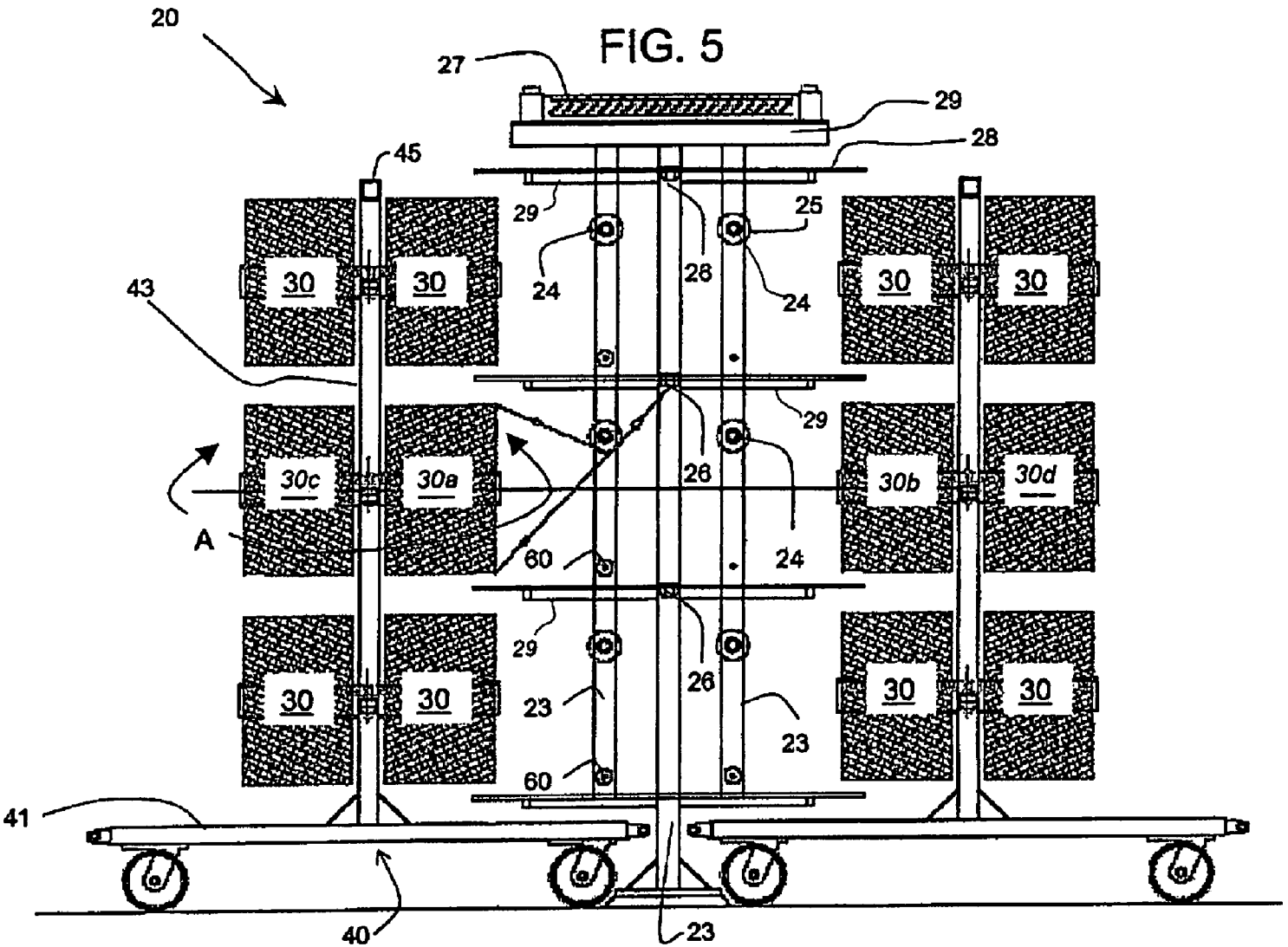
FIG. 5 depicts an end elevational view of a magazine.
Figure 6:
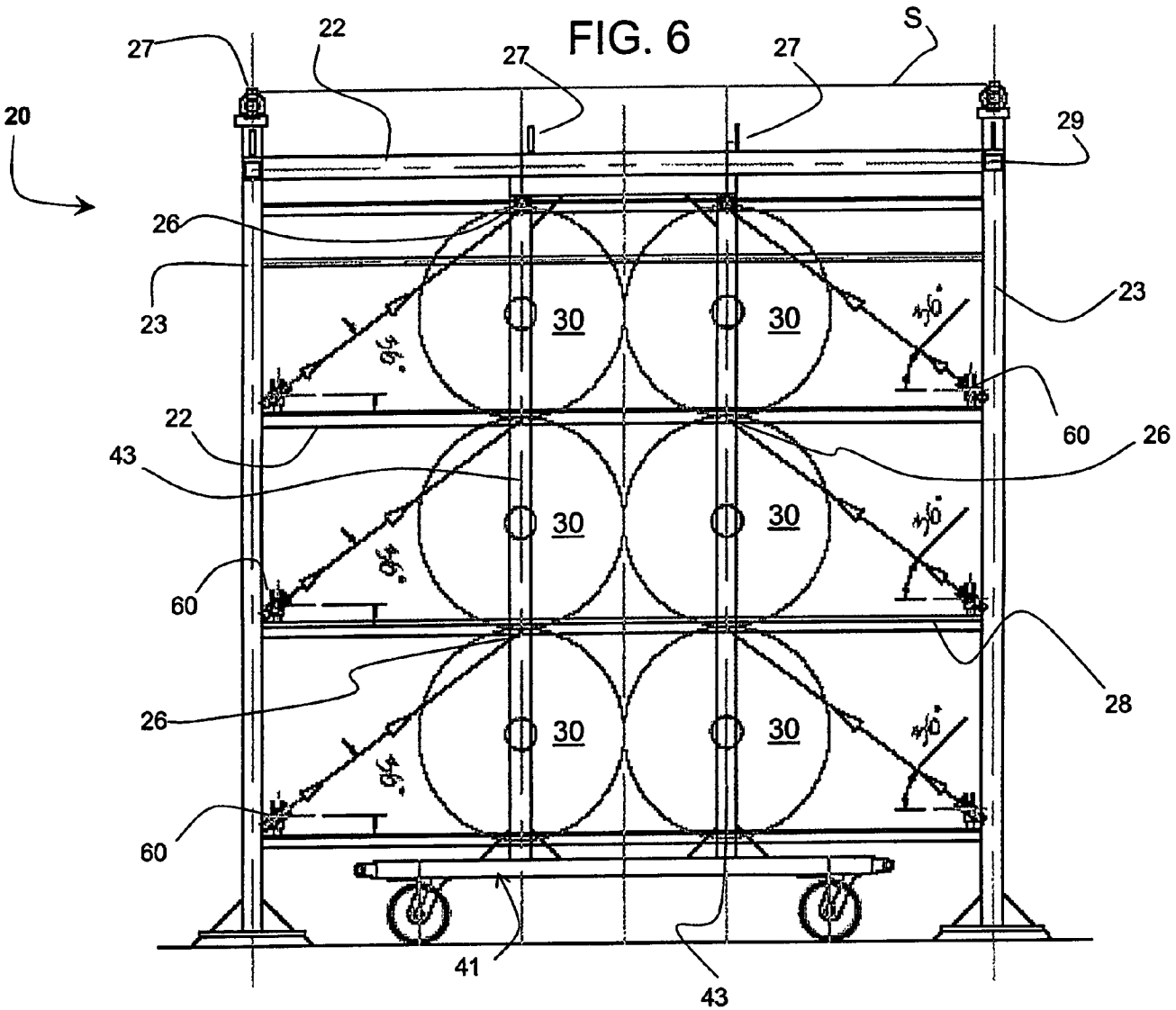
FIG. 6 depicts a side elevational view of a magazine.

Package rotator 50 may be configured according to the arrangement described in U.S. Provisional Patent Application No. 60/885,743, incorporated herein by reference, with guide channel 53 defined in a substantially horizontal plane. Alternatively, instead of providing a discrete rotator bearing, rotator bearing surface 52 may be provided by an outer surface of the vertical frame member 43 wherein guide channel 53 may be formed in the vertical frame members 43. Package rotators 50 are positioned at an appropriate elevation on vertical frame 43 based on the diameter of the package 30, the number of rows of packages on the cartridge 40, and the stranded material being utilized in the manufacturing process. A modified set collar 56 may be mounted below each rotator bearing surface 52 to support collar 51 at the bearing surface 52. Collar 51 may then be positioned on vertical frame 43 during assembly. In the embodiment depicted, collar 51 has threaded apertures 57 spaced 180 degrees apart. The support arms 44 may then be inserted into the treaded apertures 57 to protrude into the guide channel 53, thus allowing 180 degree movement around the vertical frame 43 and supporting the weight of the package 30. As best seen in reference to FIGS. 4A and 4B, cartridge 40 further comprises a guide system for routing stranded material S to magazine 20 when cartridge 40 has been inserted into magazine 20. As depicted at least one transfer device 60, described herein below, is attached at the ends of cartridge 40, to keep the interconnected strands of material from becoming entangled while the stranded materials are being supplied to the manufacturing process. Referring to FIGS. 4, 5 and 6, stationary magazine frame 21 is secured to the floor of the manufacturing facility and is fed material supplied from cartridges 40 positioned adjacent magazine frame 21 Stationary magazine frame 21 comprises a plurality of horizontal members 22 interconnecting upright members 23 positioned at opposite ends of the magazine frame 21. Upright members 23 are spaced apart by a distance corresponding to the width of cartridge 40. Horizontal members 22 are positioned between upright members 23 at a height slightly above an associated support arm 44 carried by cartridge 40 and below a superjacent support arm 44 so that the horizontal members 22 are positioned at elevations between the rows of packages 30. Transverse members 29 extend between upright members 23 or horizontal members 22 to provide lateral stability to the magazine frame 21.

Magazine frame 21, includes a magazine guide system that will accommodate each running end of material S supplied by a cartridge 30 and route it to the creel 10. As best seen in reference to FIG. 5, the guide system includes guide rods 24 extending laterally and inwardly from upright members 23 towards the interior of magazine 20, so that the running length of stranded material may be turned as it is drawn over a surface of the guide rod 24 and carried towards a primary guide 26, supported on a horizontal member 22 and positioned near a longitudinal centerline of the magazine frame 21. Guide rods 24 are positioned slightly above a longitudinal axis of its associated package 30, and laterally outwardly from a longitudinal centerline of magazine frame 21.

Primary guides 26 are provided in horizontal members 22 in spaced relation to each other to direct each strand of material from guide rod 24 and route it vertically to the top of magazine 20. Primary guides 26 are preferably ceramic, but may be made of any suitable material. Secondary guides 27, which may include a guide board or roller, are mounted on an upright member 23 proximal creel 10, and receive material from an uppermost set of primary guides 26. Material leaving secondary guides 27 is then directed towards and carried by guides 11, guide boards 12, and/or return roller 13 of creel 10, depending upon the magazine's placement in relation to creel 10.

As will be recognized by those skilled in the art, particularly with respect to stranded materials such as yarns utilized in textiles, as the yarn is pulled from the package 30, it will unwind from package 30 and form a balloon around and at the end of the package 30. Guide rod 24 is positioned to reduce the diameter of the balloon coming off the package 30. Preferably, guide rod 24 will be vertically adjustable to maintain a limiting effect on balloon formation as package 30 is depleted. Guide rods 24 may include a roller sleeve 25 to reduce friction between the rod 24 and material S as it is drawn over the turning surface.

To reduce the potential for the balloons from adjacent rows of packages from becoming entangled, magazine frame 21 may also be provided with a shield 28 supported by transverse members 29 and horizontal members 22. Shield 28 is a substantially rectangular plate, as seen in reference to FIG. 5, and extends outwardly beyond the upright frame members 23 and transverse frame members 29 so that the side edges of the shield 28 are positioned between adjacent rows of packages 30 supported on cartridge 40. As seen in reference to FIG. 6 the ends of the shield 28 may extend to and be supported by upright members 23. Preferably, shield 28 is comprised of a transparent material, such as glass or plexiglass, so that the operator may visually inspect the condition of the yarn feeds within magazine 20 and the condition of the supplying packages 30 on cartridges 40. A transparent shield 28 will also facilitate the operator's ability to join and route successive running ends of stranded material.

Magazine frame 21 and cartridges 40 should be configured such that cartridges 40 are positioned adjacent to the frame 21 in proper alignment with primary guides 26 and are secured to prevent unwanted movement during use. Any suitable means for securing carts 40 are acceptable, for example, carts 40 may be indexed with respect to magazine frame 21 such that each adjacent cart secures each other adjacent cart, or a floor track 47 or even cartridge guides 46, whether incorporated with frame 21 or ancillary to them may also be suitable.

The configuration of the creel magazine supply system thus described permits improved efficiency in the delivery of stranded material to a manufacturing process. First, the transportability of cartridges 40 permits loading of packages 30 onto cart 40 by automated methods such as that disclosed in U.S. Provisional Patent Application No. 60/885,743, so that loading of packages 30 onto support arms 44 is performed remotely from the magazine 20, thereby reducing the complexity of tasks performed at the magazines 20. Similarly, because cartridge 40 may be loaded via automated means, the size, and thereby the length of stranded material carried by a package 30 may be dramatically increased, from the 8-14 pounds in conventional manual systems, to at least forty pounds permitted by automated loading systems. Because the strand length is increased, a significant source of breakages, i.e. knots or joints, are substantially reduced, thereby contributing to the efficiency and reliability of the process.

Next, the magazine configured creel eliminates a primary and substantial source of musculo-skeletal injury exposure presented by loading packages 30 at the creel. By providing a mobile, fully loaded cartridge 40, the magazine 20 can be replenished without lifting as is necessary in conventional methods. As will be more fully described below, the creel magazine 20 of the present invention permits the system to be pre-loaded with four packages 30 of material to supply a selected primary guide 26, prior to initiating a run. The unique configuration of the magazine frame 21 and its associated cartridges 40 permits each of four packages 30 to be fed in sequence to the manufacturing process, alternating between packages 30 carried on a first cartridge 40 and second cartridge 40'. As annotated in FIG. 5, packages 30*a*-30*d*, are fed sequentially to magazine frame 21, in a modified tip to tail, back and forth fashion, whereas current systems feed tip to tail in a side by side configuration.

To run packages 30 in the modified tip to tail fashion, the leading end of material from package 30*a* is routed under guide rod 24 and then upwardly through primary guides 26 to the top of magazine frame 21. From there, the leading end is carried horizontally to secondary guide, or guide board 27 and then routed through guides 11, guide boards 12, or return roller 13 of the creel 10 depending upon a magazine's 20 placement in the process configuration. Each of the six corresponding packages 30*a*, that is, one each for the two column and three rows of packages 30 carried by the cart 40 are routed in similar manner. By advantageously guiding the materials to the top of the magazine frame 21 the strands can be routed such that the operators may have ready access to the magazine frame 21 and its associated cartridges 40.

Figure 9:
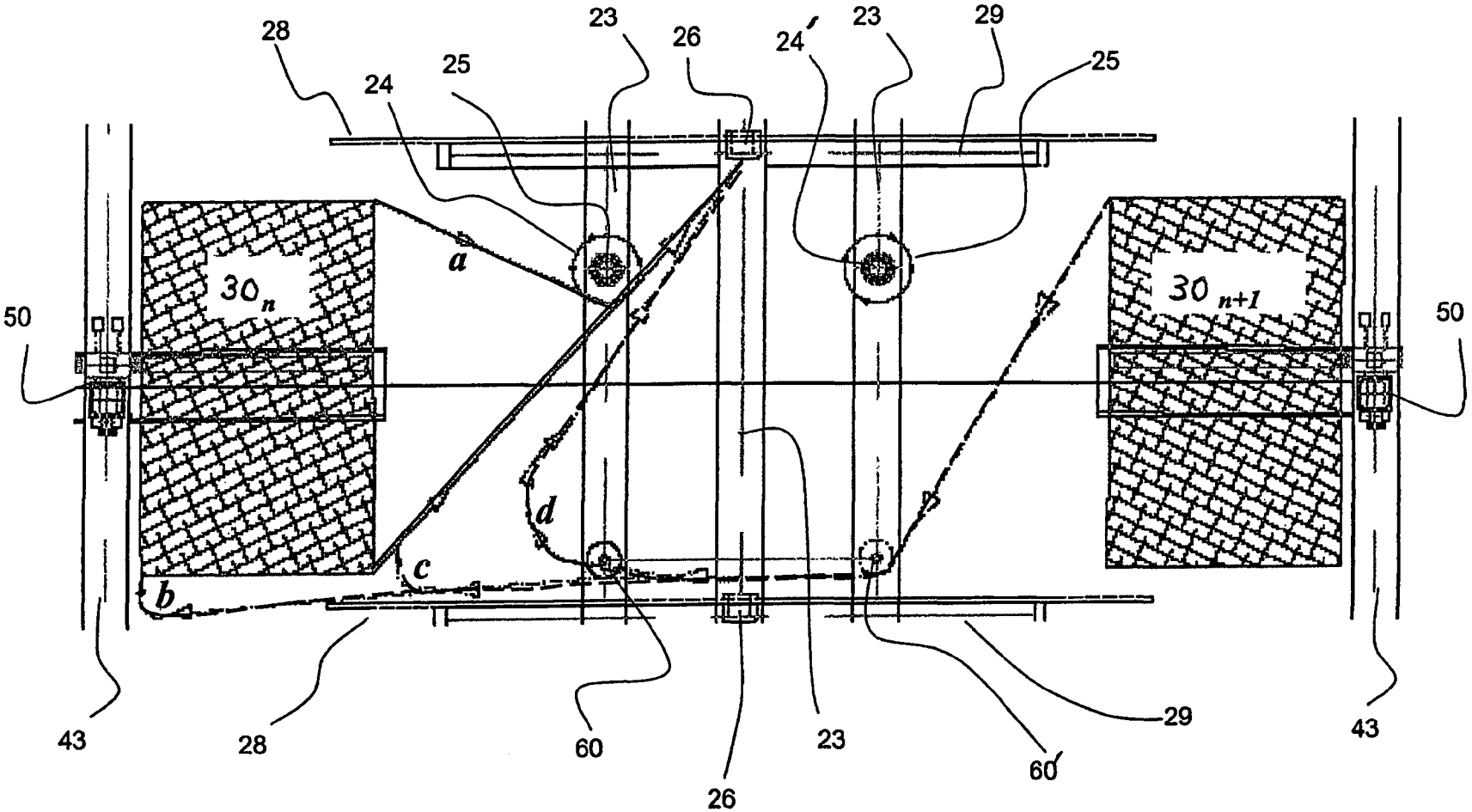
FIG. 9 depicts a detailed end elevational view of the threading of successive packages.

The transfer of stranded material across the magazine frame 21 is more clearly illustrated in reference to FIG. 9, the trailing end of package $\mathbf{30}_n$ is tied or joined with the leading end of package $\mathbf{30}_{n+1}$, which is mounted on cartridge 40' positioned transversely across magazine frame 21 from cartridge 40. As previously described, as the yarn spools off its package 30 it creates a balloon around the package 30. Therefore, when joining the tip of a subsequent package $\mathbf{30}_{n+1}$ to the tail of its preceding package $\mathbf{30}_n$, the joined material, primarily the leading end of $\mathbf{30}_{n+1}$, must be routed across magazine frame 21 yet retained out of the way to prevent the "balloon" on the running package $\mathbf{30}_n$ from tangling therewith. The running of material from the subsequent package must be allowed pull freely once transfer to the subsequent package commences.

Figure 11:
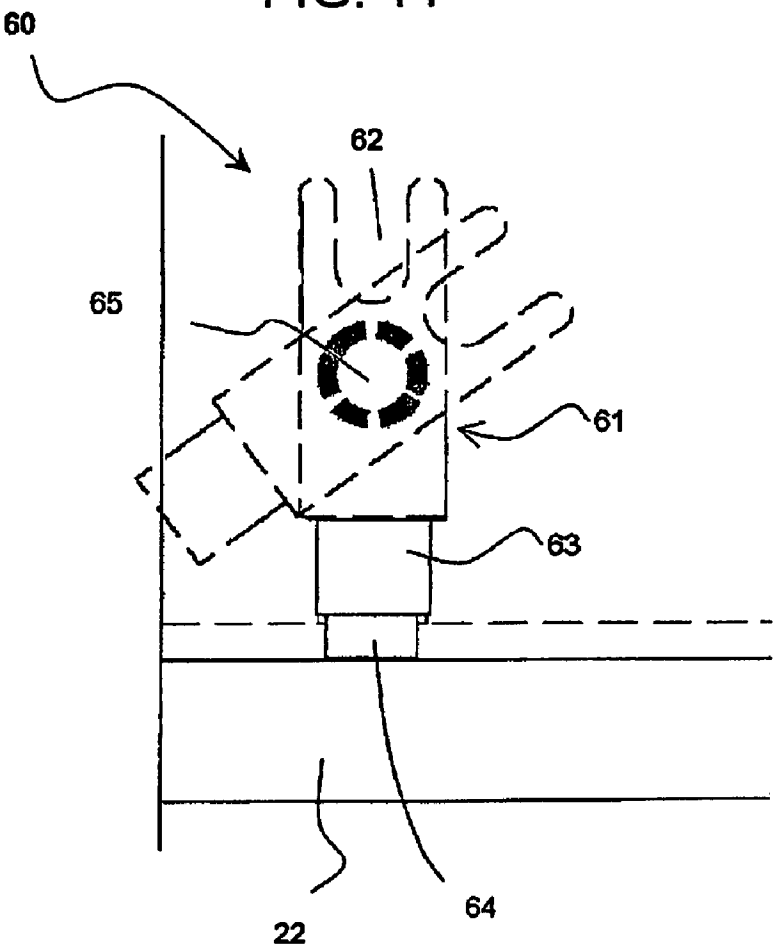
FIG. 11 depicts a side elevational view of a transfer device.
Figure 10C:
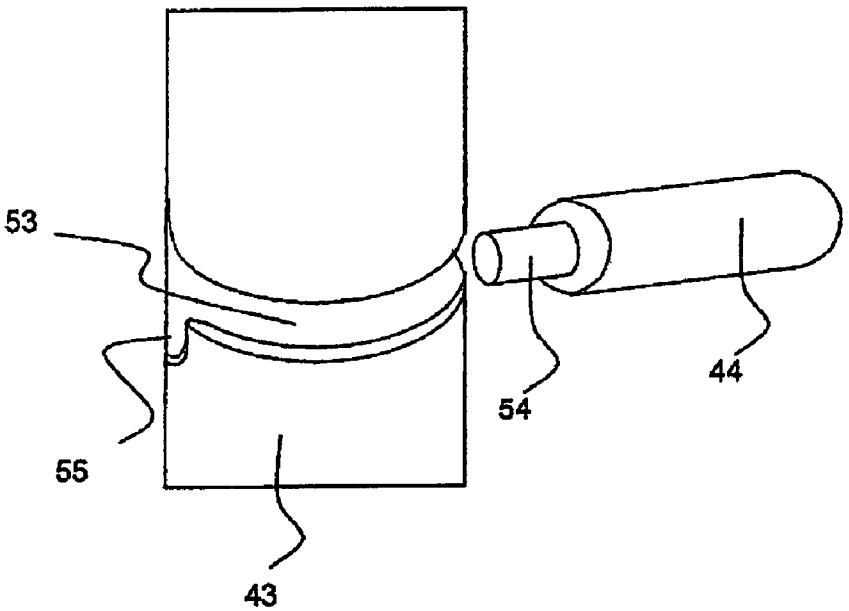
FIG. 10C depicts a perspective view of a guide channel, defined in a cartridge post.

To achieve this, a transfer device 60, such as that depicted in FIG. 11 pivotally mounted to the magazine frame 21 at a position outside the region in which moving strands tend to balloon, as may be seen in reference to FIGS. 6 and 9. Transfer device 60 comprises an elongated member or bar 61, having a U-shaped recess 62 formed at a first end of bar 61 and a counterweight 63 formed at a second end of bar 61. Bar 61 is pivotally mounted to a post 64 via a pivot 65. Counterweight 63 is selected such that recess 62 is oriented vertically in a retaining position. A slight lateral forces will permit bar 61 to pivot to a release position. Suitable results for transferring stranded materials across the magazine frame 21 can be achieved without the transfer device 60, such as by simply placing the strands atop the shield 28 and along the edge thereof so that the connecting stranded material is out of the way and will not become entangled with the running lengths or balloons of stranded material. Alternatively, a small patch of hooked fastener material, such as Velcro may be used to temporarily hold the stranded material so that it will release from the material during transfer of the running length across the magazine 20. The use of a transfer device 60 is preferred since it can provide the operator a positive visual indication that the stranded materials have been properly routed to effectuate transfer of the stranded materials across the magazine 20. In the embodiment shown in FIGS. 12 and 16, the transfer device is mounted at the corners of the magazine 20, at positions located outwardly from the packages 30.

Again, in reference to FIG. 9, the routing of the running ends is depicted in detail illustrating the initial routing of package $\mathbf{30}_n$, the modified tip to tail side by side interconnection of packages $\mathbf{30}_n$ and $\mathbf{30}_{n+1}$, and the transfer of material supply between packages $\mathbf{30}_n$ and $\mathbf{30}_{n+1}$. The initial routing of the running end of package $\mathbf{30}_n$ is shown by the arrowed line a, at the top of the left hand package $\mathbf{30}_n$. The running end is routed under guide rod 24 and upwardly to primary guide 26. At the lower left hand side, the leading end of yarn $\mathbf{30}_{n+1}$ is depicted by dashed arrowed line b, and is shown routed through transfer device 60 and tied to the tail end of package $\mathbf{30}_n$. As the material from package $\mathbf{30}_n$ is depleted, the joined ends of material $\mathbf{30}_n$ and $\mathbf{30}_{n+1}$ are drawn towards guide rod 24 and primary guide 26 as depicted by the joined lines at c, at the lower end and slightly to the right of package $\mathbf{30}_n$. As the joined ends are drawn upwardly towards primary guide 26, running end $\mathbf{30}_{n+1}$ begins to exert pressure on the side of notch 62 so that transfer device 60 tips laterally to release running end $\mathbf{30}_{n+1}$ from notch 62, shown by dashed line d, effectuating transfer of supply from package $\mathbf{30}_n$ to package $\mathbf{30}_{n+1}$. Depending upon the diameter of packages 30, an additional transfer device 60 may be required to be positioned on each cart 40 and at the outer ends thereof, so that effective retention and subsequent transfer may be effectuated. Upon complete transfer, running end $\mathbf{30}_{n+1}$ is pulled into the creel along the routing described above for package $\mathbf{30}_n$. After transfer to package $\mathbf{30}_{n+1}$ is complete the depleted package $\mathbf{30}_n$ is rotated about axis A as depicted in FIG. 5 and fresh package 30 is positioned relative to magazine frame 21. In repeating the sequence, the previously defined package $\mathbf{30}_{n+1}$ becomes $\mathbf{30}_n$. and the rotated replenished package 30 becomes the next $S_{n+1}$. According to this method, a fully loaded creel magazine 20 can provide an initial run twice that of conventional creels before the magazine 20 will require replenishment, thereby leading to greater efficiency in the process. As will be readily appreciated, once a cartridge 40 is depleted, it may be removed from the magazine 20 and replaced with a replenished cartridge 40, and the process continued.

Thus, one of the many objectives of the present invention is to allow the cartridges 40 to be loaded at a remote location so as to eliminate loading tasks at the magazine 20. Additional efficiency may be realized where a stranded material undergoes a prior process to be produced as a package 30 at the conclusion of that process. Customarily, packages 30 produced in a previous process are simply loaded and stacked in a bulk carrying cart and then wheeled to the next process station at which the packages 30 are then manually removed from the bulk carrying cart and loaded into the next process. By the method contemplated by the present invention, the packages 30 may be directly loaded onto a cartridge 40 upon completion of the previous process, thereby saving labor costs and increasing efficiency by eliminating double handling the packages 30.

The unique capability of the invention to sequentially transfer the delivery of stranded material S from packages 30 located on one side of the creel magazine 120 to a package 30 on another side of the creel magazine 120 lends itself to further efficiencies in the manufacturing process. In accordance with the principles discussed above, an alternative preferred embodiment of a creel magazine according to the invention is illustrated in FIGS. 12-16, in which alternating cartridges 140 supply stranded materials to the creel magazine frame 121. Rather than replenishing individual support arms 144 as their associated packages 30 are depleted, this embodiment of the invention contemplates replacement or replenishment of packages on alternating sets of cartridges 140, such that the creel can be continuously supplied with stranded material. Packages 30 are preferably loaded onto the cart 140 at the output of a prior processing step, thereby substantially reducing the handling of the packages 30. The transfer capability of the invention thus permits continuous, non-stop running of the manufacturing process by successively replacing alternating odd and even numbered carts 140 as their respective packages 30 become depleted.

Because there is no need to rotate depleted packages 30 on cart 140 in this embodiment of the invention, the construction of carts 140 for this embodiment can be greatly simplified. It will be appreciated from FIGS. 13-15 that the alignment and separation of adjacent support arms 144 will be governed by the size of the packages 30 utilized by the process. Where a fixed size package 30 will be utilized in the process, the support arms 144 are preferably attached to the cartridge 140 in a fixed orientation relative to the magazine frame 121, such as by welding, or they may be adjustably attached, such as by a bolt. As more clearly seen in reference to FIGS. 13 and 15, the support arms 144 are preferably attached to the cartridge 140 such that their longitudinal axis is directed substantially toward the primary guide 126, or a ring guide 70, described below.

Proper alignment of the support arms 144 with the primary guide 26, or ring guides 70, can be facilitated by indexing the cartridge 140 positioning with respect to the creel magazine 120. To this end, as seen in reference to FIGS. 12 and 15, the cartridge 140 may be retained in position relative the magazine 120, such as via a downwardly extending pin 146 that is engaged in a track 147, thereby maintaining the proper lateral separation between the cart 140 and the magazine frame 121. Track 147 will have an opening at its first end for receiving the pin 146. Preferably a stop 148 is provided at an opposite end of the track 147, to provide a positive indication of the proper longitudinal positioning of the cart 140 relative to the magazine 120.

Figure 12:
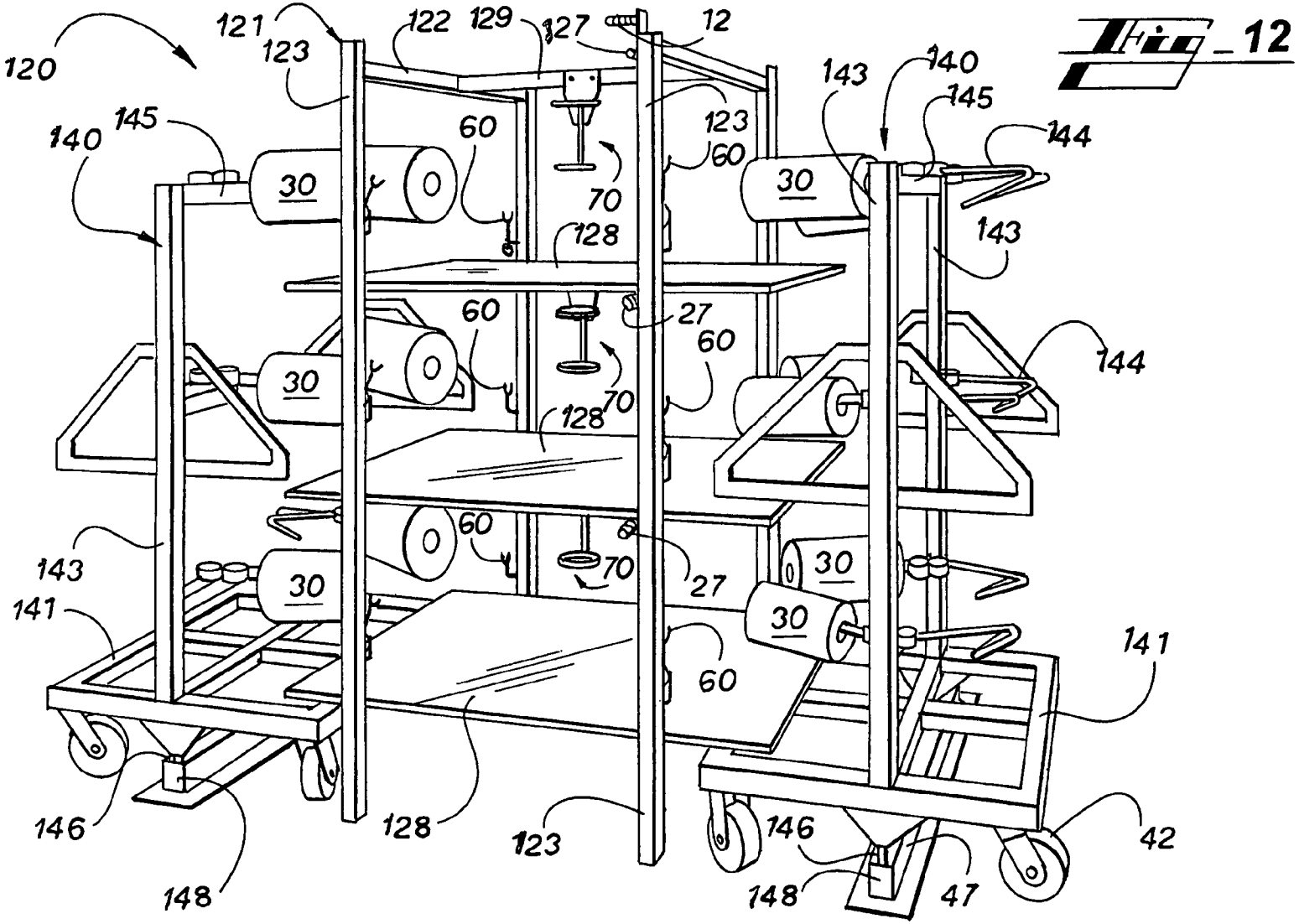
FIG. 12 depicts a perspective view of a creel magazine configured with a ring guide.
Figure 19A:
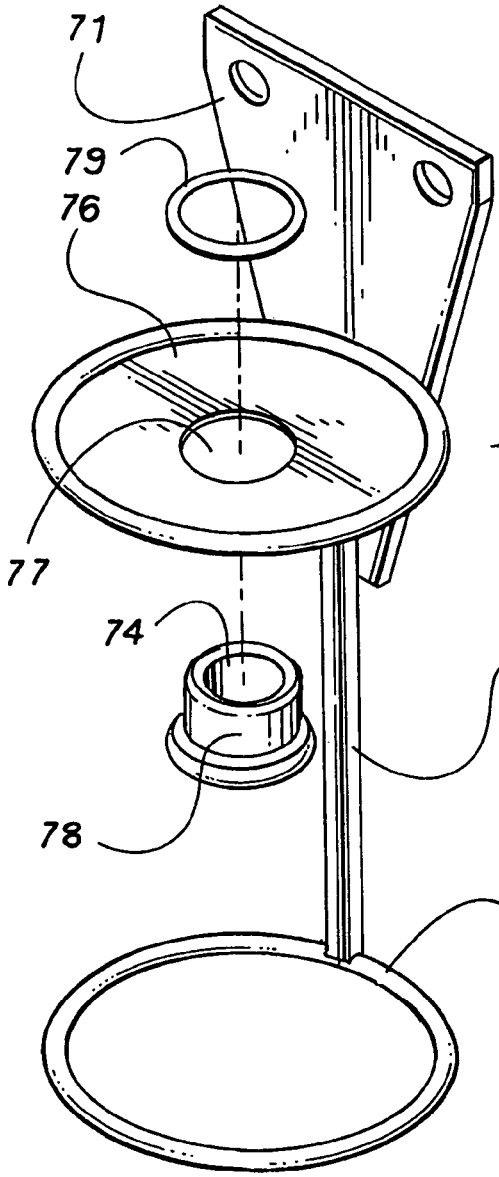
FIG. 19A depicts a perspective view of a ring guide according to a preferred embodiment of the invention.
Figure 19B:
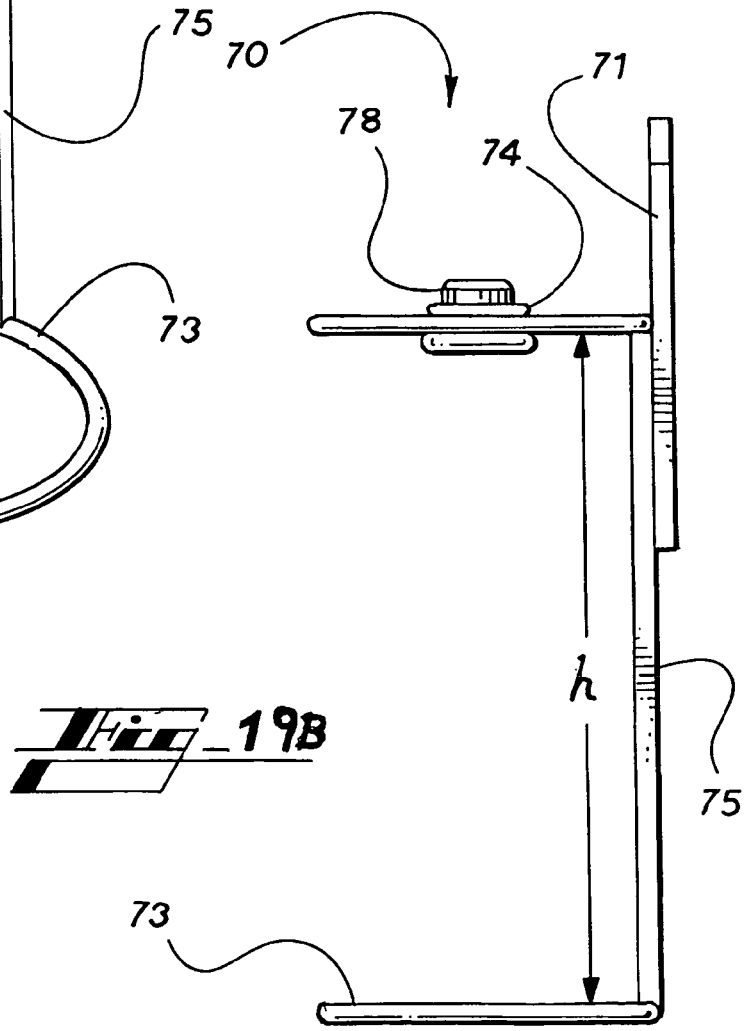
FIG. 19B depicts a side elevational view of a ring guide according to a preferred embodiment of the invention.

As further seen in reference to FIG. 12, the guide rods 24 and sleeve 25 of the previous embodiments may be replaced by a ring guide 70 mounted by any suitable means at a central position in the magazine frame 121. In this embodiment the stationary magazine frame 121 includes a transverse frame member 129 connected between the horizontal members 122, preferably at a mid point of the magazine frame 121. As detailed in FIGS. 19A and 19B, the ring guide 70 has an attachment plate 71 for attachment to transverse member 129 via bolts 72, clamps, welds or any suitable means. The ring guide 70 further comprises a lower ring having an annular turning surface 73 and an upper ring, mounted substantially parallel to the lower ring, defining an upper turning surface 74 which are substantially parallel to one another. Preferably the upper rings are coaxially aligned. Best results may be achieved where turning surfaces 73 and 74 are separated from one another by a distance h corresponding to the diameter of the stranded material package 30, such that the plane of the lower annular turning surface 73 is generally aligned with, and preferably slightly elevated from the center axis of the package 30, or the support arm 144. The upper turning surface 74 is positioned so that it is generally aligned with, and more preferably, slightly elevated above the outer diameter of a fully loaded package 30 so as to provide clearance between ballooning around package 30 and the running length of material as it is routed to the secondary guides 127. In the embodiment shown, the annular turning surface 73 is attached to an elongate rod 75, or bar extending downwardly from the attachment plate 71, while the upper turning surface 74 may be supported on a plate 76 connected to either the attachment plate 71 or the elongate rod 75. The upper turning surface 74 is preferably a standard ceramic guide 78, of a type well known in the art, that is received in a bore 77 defined in plate 76, and retained by a resilient ring 79, snap-ring, adhesives or the like. The lower annular turning surface 73 preferably has a diameter that is substantially larger than that of the upper turning surface, and generally on the order of between about 3 to 8 inches. Annular turning surface 73 functions in essentially the same manner as the guide rods 24 in controlling ballooning of the stranded material S as it is drawn from packages 30, and turns the running length of stranded material from a generally horizontal travel to a vertical travel as it is drawn upwards towards upper turning surface 74. The ring shape of the annular turning surface 73 permits the ring guide 70 to receive and control ballooning in the stranded material from any direction, regardless of which package 30 is feeding the magazine and is especially beneficial to control ballooning when the strands transfer across the magazine frame 121 from one cart to the other. When the running length of stranded material passes through the upper turning surface 74, it turns the stranded material to a generally horizontal travel so that the stranded material may be carried outwardly to the lateral aspects of the magazine 120.

Figure 17:
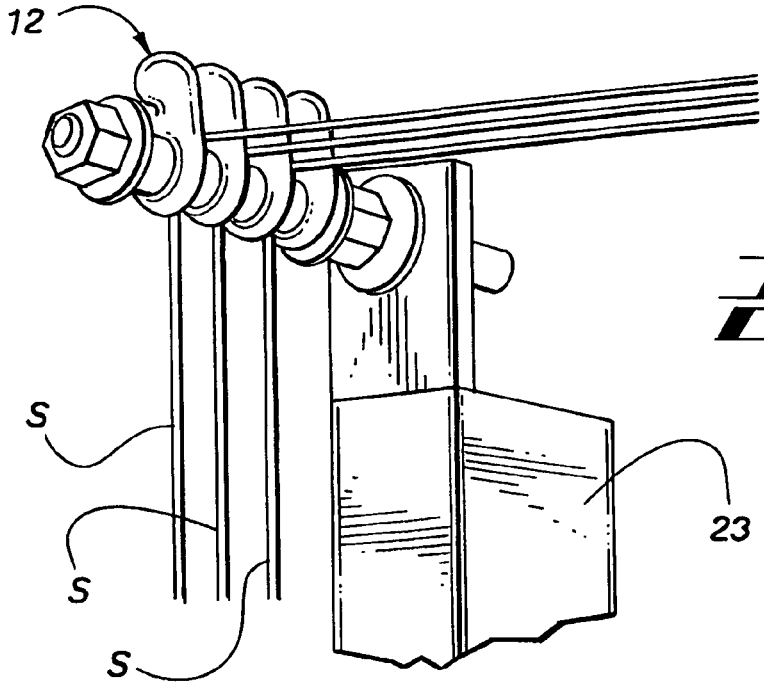
FIG. 17 depicts an embodiment of a guide board.
Figure 18:
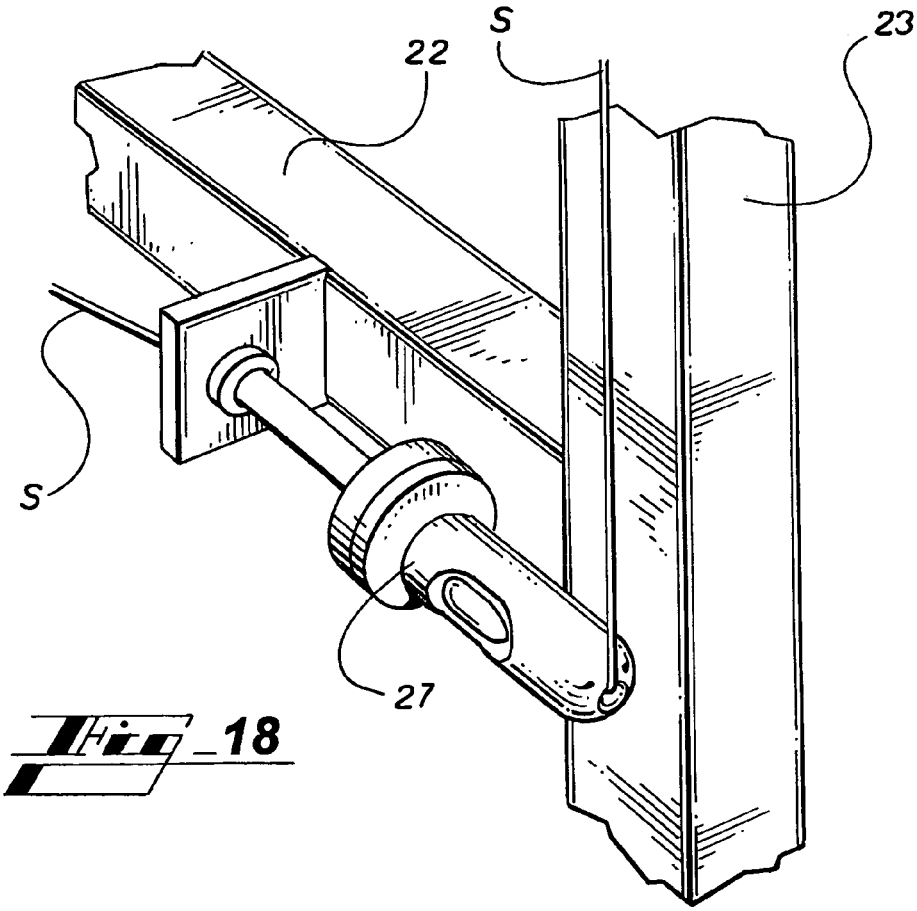
FIG. 18 depicts an embodiment of a secondary guide.

Routing of the stranded material is substantially similar to that in the earlier described embodiments. As best seen in reference to FIGS. 13 and 15, the stranded material is routed from package 30*a* horizontally to the ring guide 70 as shown by segment a. The stranded material is then routed through the lower annular turning surface 73, through the upper turning surface 74, and then laterally to a secondary guide 127, as shown by segment b. Secondary guide 127 may be positioned at any point along the lateral aspect of the magazine frame 21, such as at a corner as depicted in FIG. 14, or near a midpoint thereof, as shown in FIG. 15. A secondary guide 127, such as depicted in FIG. 18 is provided for each level and running length of stranded material carried by the magazine frame 121. In the embodiment illustrated in FIGS. 12-15, a single running length of stranded material is supplied to the manufacturing process for every level of packages 30 carried by the associated carts 140. From the secondary guides 127 located at the lateral aspect of the magazine frame 121, the running lengths are routed vertically to a guide board 12, such as that depicted in FIG. 17, mounted at the top of the magazine frame 121.

Figure 16A:
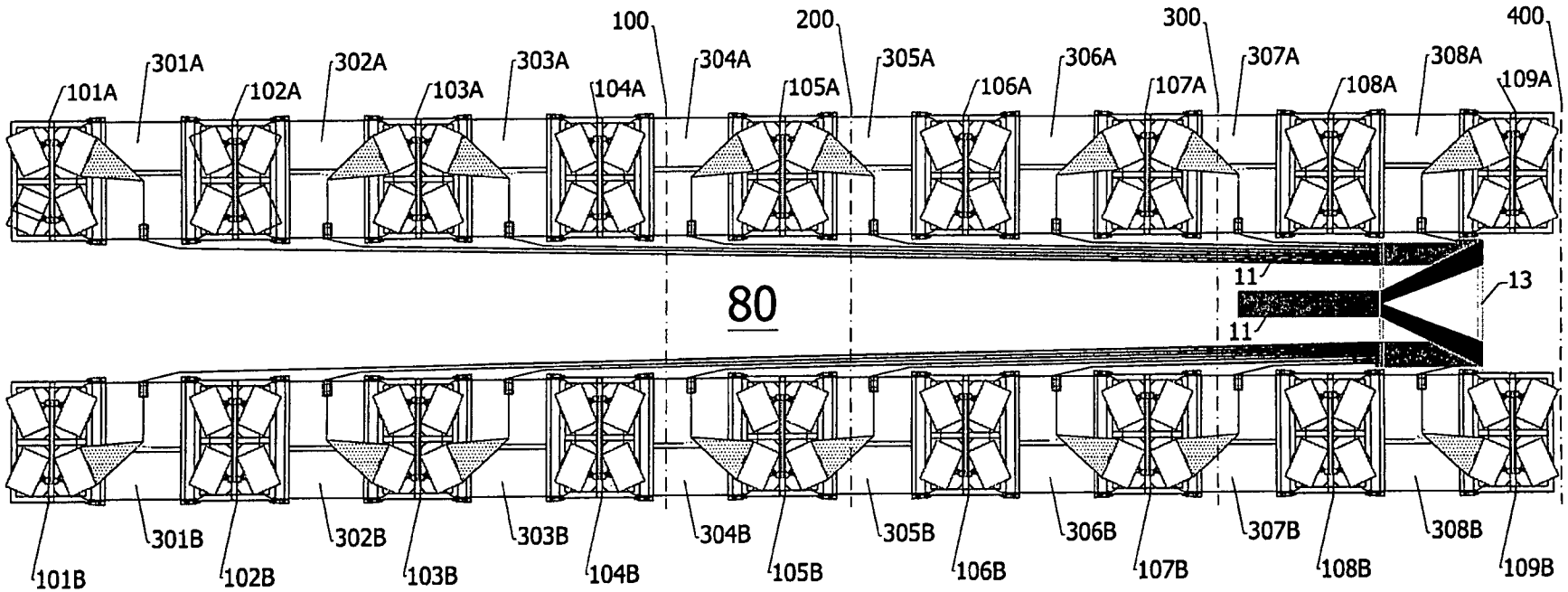
FIG. 16A depicts a plan view of a creel magazine system according to a preferred alternative embodiment of the invention with stranded materials supplied by odd numbered carts.
Figure 16B:
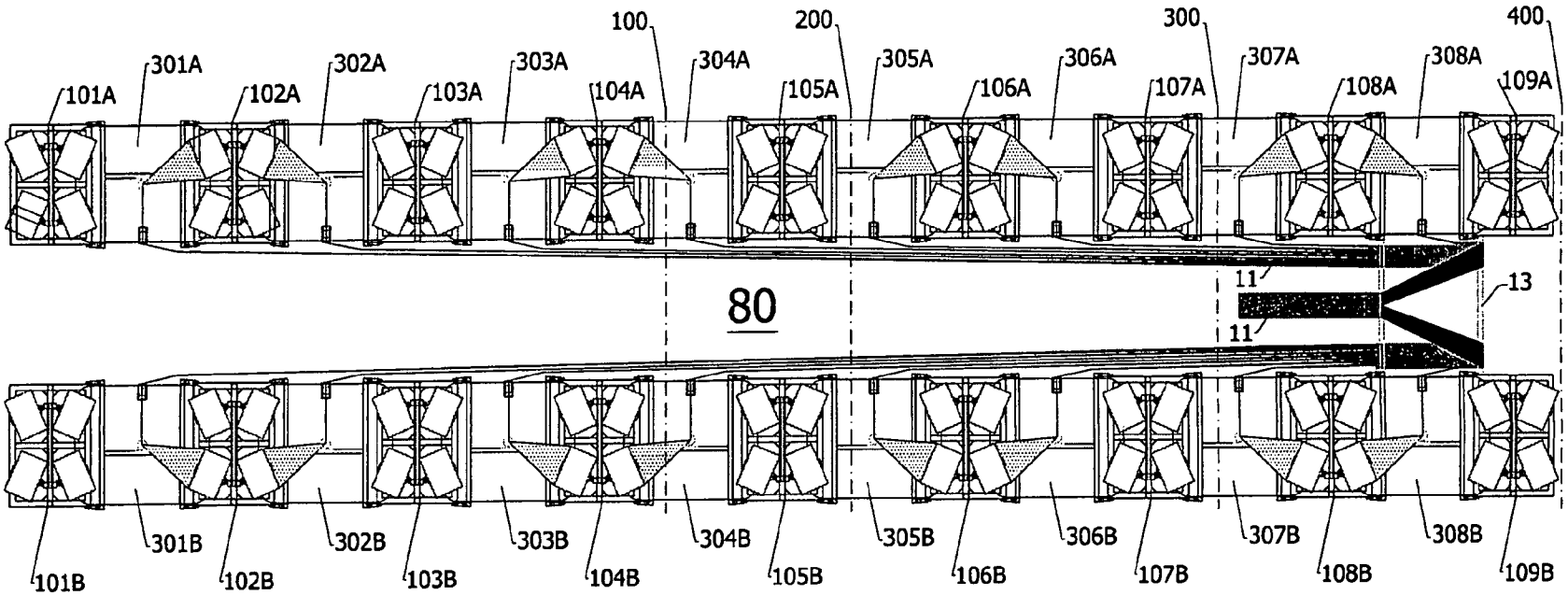
FIG. 16B depicts a plan view of a creel magazine system according to a preferred alternative embodiment of the invention with stranded materials supplied by even numbered carts.

According to this embodiment, a continuous supply of stranded material can be fed to the manufacturing process by the combination of a plurality of magazines 120 and associated carts 140 in a manner depicted in FIGS. 16A and 16B. Note that dashed lines 100, 200, 300 and 400 merely indicate that the number of magazines and carts can be in stalled in any grouping desired, with a minimum optimum configuration of one magazine 120 and two carts 140 to serve the magazine. In the embodiment of the invention shown in FIG. 16A, in the first grouping the three magazine frames 301, 302, and 303, starting from the left side of the drawing to the dashed line 100, are disposed in parallel on opposite sides of a yarn run alley 80, in two banks of three magazine frames 301A & B, 302A & B, and 303A & B, for a total of six magazines. These six magazines are serviced by eight magazine carts 101A & B, 102A & B, 103A & B, and 104A & B, with four carts on each side of the yarn run alley 80. In this grouping, each magazine will route three running strands to the creel along yarn run alley 80, thus this grouping is capable of continuously supplying up to eighteen running ends of stranded materials to the manufacturing process. In this embodiment carts 101, 102, 103 and 104 are parked between magazine frames 301, 302, and 303 such that a single cart will simultaneously supply the two magazines that are adjacent to the cart. For example, cart 103A can simultaneously supply stranded material from opposite sides of the cart to feed magazine frames 302A and 303A, thus each active cart supplies six running strands simultaneously from one of the packages 30 in each row on the cart.

With each of the magazine frames routing three running lengths of stranded material, the strand count can be incrementally increased by the addition of magazine frames 121 and associated carts 140. As shown by the system depicted in FIG. 16, the grouping of carts 101A & B-105A & B, and magazine frames 301A & B-304A & B, shown to the dashed reference line 200, up to twenty four running lengths of stranded material can be provided. In the system shown through reference line 300, the creel magazine system can incrementally increase the strand count to thirty six strands, by the addition of carts 106A & B and 107A & B and magazine frames 305A & B-306A & B. Similarly, in the system shown through reference line 400, a strand count of up to forty eight running lengths can be achieved. The invention thus provides for a modular, readily configurable system 10 to supply a desired number of strand counts to a manufacturing process.

Figure 13:
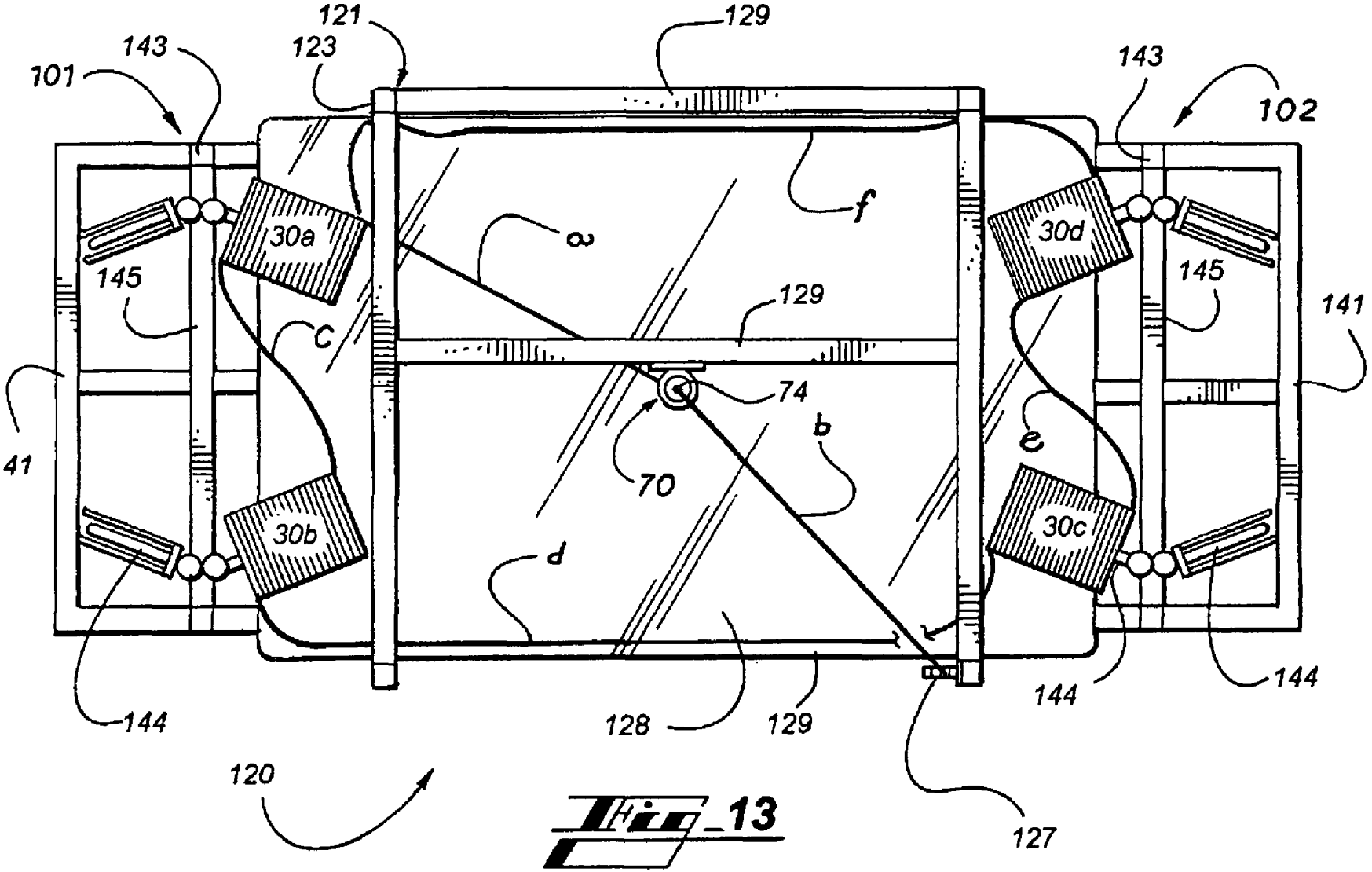
FIG. 13 depicts a plan view of a creel magazine configured with a ring guide.
Figure 14:
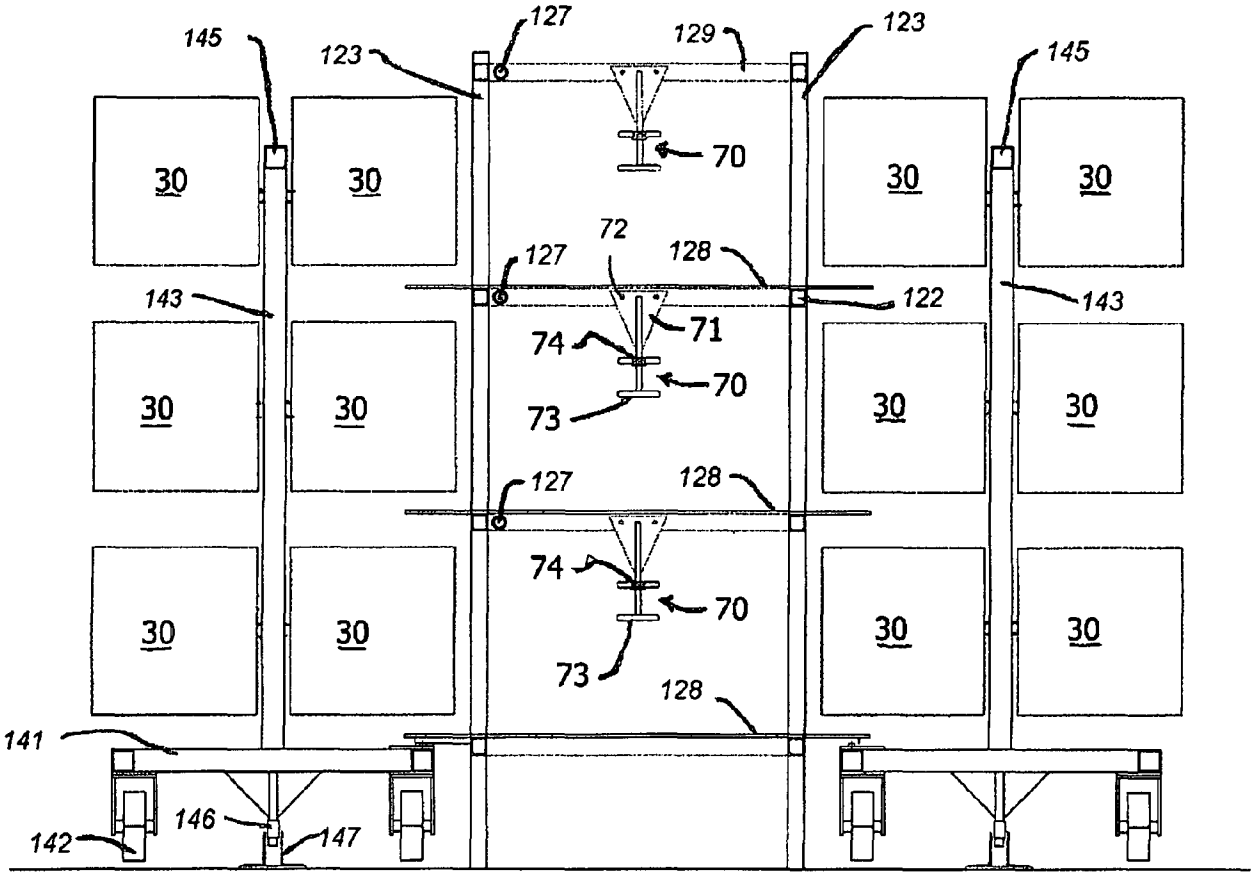
FIG. 14 depicts a side elevational view of a creel magazine configured with a ring guide.
Figure 15:
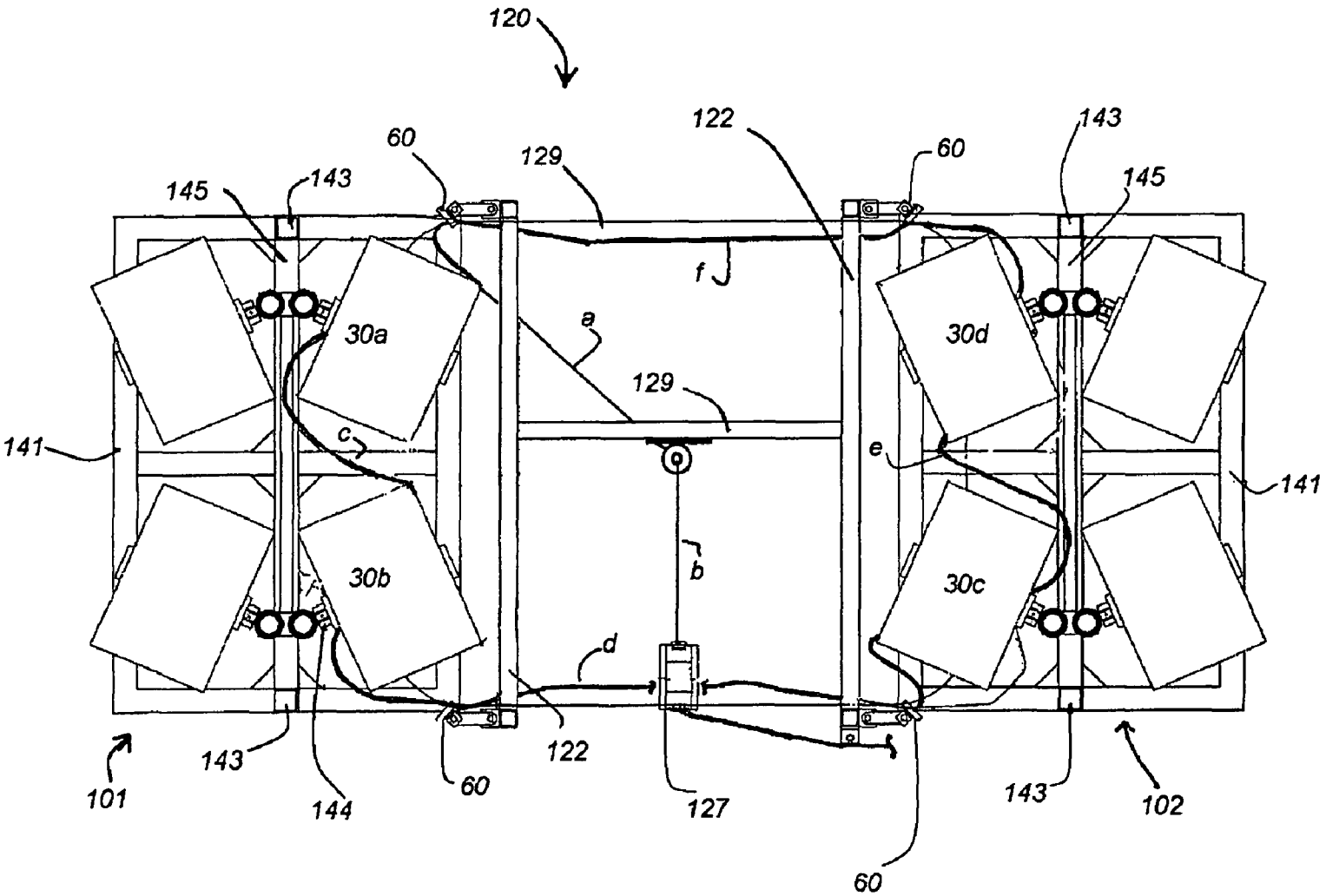
FIG. 15 depicts a detailed view illustrating the routing of the stranded material in the magazine shown in FIGS. 12-14.

While the carts 140 and magazine frames 121 shown in FIGS. 12-14 are depicted to supply three running lengths of stranded materials, the invention contemplates that they may be modified to carry additional running lengths of stranded materials, such as by increasing their capacity for supporting additional packages 30 and guides 70 either the vertically, longitudinally or a combination of the two.

As described in greater detail below, continuous running of the manufacturing process may be accomplished where the system alternates delivery of stranded materials between odd numbered carts 101, 103, 105, 107, 109 and even numbered carts 102, 104, 106, 108 to supply material to the adjacent magazine frames 301-308 and thence to the manufacturing process, as shown in FIGS. 16A and 16B respectively. By way of example, referring to FIG. 16A, cart 103 simultaneously supplies three running strands to frame 302 and three running strands to frame 303. At the same time cart 105 simultaneously supplies strand to frames 304 and 305 while cart 107 supplies stranded material to frames 306 and 307. Detailed routing of the stranded material is shown in reference to FIGS. 13 and 15, where stranded material from an active package 30*a* in each row adjacent a magazine frame 121 on the odd numbered carts is routed through the ring guide 70 dedicated to that level of the magazine frame and is routed laterally to a secondary guide 127, shown by segments a and b, and then vertically to guide boards 12, from which it is routed to the manufacturing process. As depicted by segment c, the trailing end of package 30*a* is tied to the leading end of the stranded material on ready package 30*b*, also on the same side and row of odd numbered cart, e.g. cart 103. As shown by segment d, the trailing end of package 30*b* is routed across the adjacent magazine frames 302 and 303 through transfer devices 60 and tied to the leading end of ready package 30*c* carried by even numbered cart 102 and 104 respectively. Finally, as shown by segment e, the trailing end of package 30*c* is tied to the leading end of ready package 30*d* on cart 102 and 104 respectively.

Once the packages 30 carried by the odd numbered carts 101, 103, 105, 107, 109 have been depleted, the running ends of the stranded materials will transfer across the magazine 120, as in the manner previously described, and begin to draw stranded material from packages 30 carried on the even numbered cartridges 102, 104, 106, 108, as shown in reference to FIG. 16B. That is to say, carts 102 will begin supplying running strands to magazines 301 and 303, carts 104 begins supplying running strand material to magazines 303 and 304 and so on. Once delivery of the running ends has transferred to the even numbered carts 102, 104, 106, 108, the odd numbered carts 101, 103, 105, 107, 109 can be removed from the line and replaced with full or replenished packages 30, or more preferably, the carts may be replaced by another set of carts 140 carrying full or replenished packages 30, preferably loaded at the output of a prior manufacturing process. The leading ends of the stranded material on ready packages 30 carried by each row of the replenished odd numbered carts 101, 103, 105, 107, 109 are then tied to the tail ends of ready packages 30 of the even numbered carts 102, 104, 106, 108 for subsequent transfer of delivery back to the odd numbered carts once the even numbered carts have been depleted. Thus, by alternating the feeding of stranded materials to the manufacturing process between odd and even numbered carts 140, the system can be run continuously without the need to stop and reload packages 30 on the individual support arms 144, thereby adding greater efficiency, and reducing the hazard of worker injury.

It will be appreciated that magazine creel system 10 does not necessarily need to supply stranded materials according to the odd even distribution described above. By way of example, the upper half, or first bank, of the system shown in FIG. 16 may feed the manufacturing process from its odd numbered carts, while the lower half, or second bank, of the system feeds the manufacturing process from its even numbered carts. Each would transfer delivery of stranded materials to their respective counterpart carts upon depletion of the packages 30 carried thereon. Thus, for ease of understanding the creel magazine system of the invention, a cart 140 that is actively supplying stranded materials to the magazine frame 121 (or the cart that will initially deliver the stranded material) is referred to as an active cart, while a cart 140 that is carrying replenished or full packages 30 can be referred to as a ready cart. Similarly, a package 30 that is actively supplying stranded material to the magazine 120 (or the package from which stranded material is initially delivered) is referred to as an active package, while a package 30 that is not actively supplying stranded material to the magazine 120 is referred to as a ready package. While the preferred embodiments shown include pairs of packages 30 positioned on opposite sides of the magazine 120, the contemplated invention may be practiced by transferring delivery of stranded material between single packages 30 carried on opposite sides of the magazine 120. Thus, in the preferred embodiments of the invention a ready package may be one that is not actively supplying the manufacturing process, regardless of whether the ready package is supported on an active or ready cart.

The method of supplying stranded material to a manufacturing process by the creel magazine system 10 of the invention can also be described as feeding a running length of stranded material S to a guide 126, 70 supported by the stationary magazine frame 121 from an active package 30 supported on at least one support arm 144 of the active cart 140, the active cart being positioned at a first side of the magazine 120. Sequentially transferring supply of the stranded material S upon depletion of the active package, to a ready package carried on at least one support arm 144 of the ready cart that is positioned on another side of the magazine 120. The active package and a ready package are operatively joined by interconnecting a trailing end of the stranded material on the active package with a leading end of the stranded material on the ready package. In similar fashion, additional ready packages 30, supported on additional support arms 144 may be included by interconnecting a trailing end of the stranded material from a preceding ready package to a leading end of the stranded material from a subsequent ready package. Greater efficiency can be achieved by the system where at least one additional ready package is carried by the active cart and the ready cart. The additional ready packages, such as in the embodiment depicted, are interposed between the active package and one of the ready package carried by the ready cart. In this manner twice the amount of stranded material may be supplied by an active cart before transferring supply of the stranded material to the ready cart.

While this invention has been described with reference to preferred embodiments thereof, it is to be understood that variations and modifications can be affected within the spirit and scope of the invention as described herein and as described in the appended claims.

I claim:

1. A creel magazine for feeding stranded material to a manufacturing process comprising: a magazine having a stationary magazine frame comprising a common guide for said stranded material; a first and a second removable cartridge positioned adjacent said magazine frame on respective opposite sides of said frame, said first removable cartridge having at least one support arm supporting an active package of stranded material thereon; said second removable cartridge having at least one support arm supporting a ready package of stranded material thereon; wherein a trailing end of said active package is connected to a leading end of said ready package such that said stranded material is sequentially and continuously fed to said common guide from said active package then from said ready package.

2. The creel magazine of claim 1, wherein said common guide is an annular turning surface positioned to receive stranded material fed from said active package.

3. The creel magazine of claim 2, wherein said common guide further comprises an upper turning surface supported above said annular turning surface.

4. The creel magazine of claim 3, wherein said annular turning surface and said upper turning surface are separated by a distance corresponding to the diameter of said packages.

5. A creel magazine for feeding stranded material to a manufacturing process comprising: a magazine having a stationary magazine frame comprising a common guide for said stranded material; a first and a second removable cartridge positioned adjacent said magazine frame on respective opposite sides of said magazine frame, said first removable cartridge having at least one support arm supporting an active package of stranded material thereon; said second removable cartridge having at least one support arm supporting a ready package of stranded material thereon wherein a trailing end of said stranded material carried by said active package is connected to a leading end of said stranded material carried by said ready package; wherein said common guide is an annular turning surface and said stranded material is sequentially fed to said common guide from said active package then from said ready package.

6. The creel magazine of claim 5, further comprising an additional support arm supported adjacent to said at least one support arm for supporting an additional ready package on said first removable cartridge, to be selectively interposed between said active package and said ready package on said second removable cartridge to feed said stranded material.

7. The creel magazine of claim 5, further comprising an additional support arm supported adjacent to said at least one support arm for supporting an additional ready package on said second removable cartridge to be selectively interposed between said active package on said first removable cartridge and said ready package on said second removable cartridge to feed said stranded material.

8. A creel magazine system for supplying stranded material to a manufacturing process comprising: a plurality of stationary magazine frames each comprising a guide through which said stranded material passes; a first movable cartridge and a second movable cartridge positioned adjacent at least one of said plurality of magazine frames on respective opposite sides of said at least one of said plurality of magazine frames, each said movable cartridge having at least one support arm for mounting thereon a stranded material package, such that stranded material from said stranded material package supported on said first movable cartridge is sequentially connected to stranded material from at least one other stranded material package supported on said second movable cartridge to continuously supply said stranded material to said guide.

9. The creel magazine system of claim 8, wherein said guide is a ring guide defining a lower vertically opening aperture supported at substantially the same height as said at least one support arm.

10. The creel magazine system of claim 9, wherein said ring guide further defines an upper aperture supported above said lower vertically opening aperture.

11. The creel magazine system of claim 8, further comprising a transfer device attached to said magazine frame, wherein said transfer device releasably receives said stranded material connected between said first package and said second package.

12. A creel magazine system for supplying stranded material to a manufacturing process comprising: a plurality of stationary magazine frames comprising a guide through which said stranded material passes; a first movable cartridge and a second movable cartridge positioned adjacent at least one of said plurality of magazine frames on respective opposite sides of said at least one of said plurality of magazine frames, each said movable cartridge having at least one support arm for mounting thereon a stranded material package, such that said package is sequentially connected to at least one other package to supply said stranded material to said guide wherein a trailing end of stranded material carried by a first stranded material package in said first movable cartridge is connected to a leading end of said stranded material carried by a second stranded material package on said second movable cartridge, such that delivery of said stranded material is continuous from said second package upon depletion of said first package.

13. The creel magazine system of claim 12, wherein at least one additional package is operatively interconnected to be interposed between said first package and said second package.

14. A method of continuously supplying a stranded material to a manufacturing process comprising the steps of:

a. supplying a running length of the stranded material to a creel magazine from an active package supported on at least one support arm of a removable active cart positioned at a first side of the magazine;

b. interconnecting a trailing end of the stranded material on the active package with a leading end of stranded material on a ready package supported on at least one support arm of a removable ready cart positioned at a second side of the magazine which is opposite said first side relative to said magazine;

c. sequentially transferring supply of the stranded material from the active package at said first side to the ready package at said second side upon depletion of the active package.

15. The method of claim 14, further comprising the step of interposing at least one additional ready package between the active package and the ready package such that a leading end of the stranded material on the at least one additional ready package is connected to a trailing end of the stranded material on the active package and a trailing end of stranded material of the at least one additional ready package is connected to the leading end of stranded material on the ready package.

16. The method of claim 15, wherein the at least one additional ready package is supported on a second support arm of the removable active cart.

17. The method of claim 16, further comprising the step of transferring supply of the stranded material from the removable active cart across the magazine to the removable ready cart upon depletion of the packages on the removable active cart.

18. The method of claim 15, wherein the at least one additional ready package is supported on an additional support arm of the ready cart.

19. The method of claim 14, further comprising replacing a cart positioned at a side of said magazine having a depleted package with a replacement cart having a replenished package.

20. The method of claim 19, further comprising the step of interconnecting a leading end of the stranded material from a replenished package with a trailing end the stranded material from the active package.

21. The method of claim 20, further comprising the step of interconnecting a leading end of a replenished package with a trailing end of the ready package carried by the removable active cart.

* * * * *